US007942407B2

(12) United States Patent
Someya et al.

(10) Patent No.: US 7,942,407 B2
(45) Date of Patent: May 17, 2011

(54) SHEET PROCESSING APPARATUS AND IMAGE FORMING APPARATUS

(75) Inventors: Osamu Someya, Moriya (JP); Naoyasu Funada, Moriya (JP)

(73) Assignee: Canon Finetech Inc., Misato-shi (JP)

( * ) Notice: Subject to any disclaimer, the term of this patent is extended or adjusted under 35 U.S.C. 154(b) by 127 days.

(21) Appl. No.: 11/405,467

(22) Filed: Apr. 18, 2006

(65) Prior Publication Data

US 2006/0244200 A1 Nov. 2, 2006

(30) Foreign Application Priority Data

Apr. 28, 2005 (JP) ..... 2005-133674

(51) Int. Cl.
*B65H 31/26* (2006.01)

(52) U.S. Cl. ..... 271/220; 270/58.12; 270/58.16; 270/58.17; 270/58.27

(58) Field of Classification Search ..... 271/207, 271/220; 270/58.12, 58.16, 58.17, 58.27
See application file for complete search history.

(56) References Cited

U.S. PATENT DOCUMENTS

| | | | | |
|---|---|---|---|---|
| 4,946,153 | A * | 8/1990 | Kinoshita et al. | 270/58.17 |
| 5,013,021 | A * | 5/1991 | Johdai et al. | 270/58.12 |
| 5,037,077 | A * | 8/1991 | Kubota et al. | 270/58.12 |
| 5,120,046 | A * | 6/1992 | Mandel et al. | 271/220 |
| 5,346,203 | A * | 9/1994 | Stemmle | 271/288 |
| 5,622,359 | A * | 4/1997 | Kawano et al. | 270/58.12 |
| 6,102,385 | A * | 8/2000 | Wakamatsu et al. | 270/58.12 |
| 6,171,225 | B1 * | 1/2001 | Nonoyama et al. | 493/16 |
| 6,220,592 | B1 * | 4/2001 | Watanabe et al. | 271/241 |
| 6,561,504 | B2 * | 5/2003 | Mlejnek et al. | 270/58.12 |
| 6,910,688 | B2 * | 6/2005 | Saito et al. | 271/220 |
| 6,986,510 | B2 * | 1/2006 | Saito et al. | 271/220 |
| 7,497,425 | B2 * | 3/2009 | Taguchi et al. | 270/37 |
| 7,665,729 | B2 * | 2/2010 | Taki et al. | 271/207 |
| 2002/0038934 | A1 * | 4/2002 | Sasamoto et al. | 271/207 |
| 2003/0090055 | A1 | 5/2003 | Saito et al. | |
| 2004/0181308 | A1 * | 9/2004 | Hayashi et al. | 700/223 |
| 2005/0206071 | A1 * | 9/2005 | Suzuki et al. | 271/207 |
| 2007/0029723 | A1 * | 2/2007 | Sato | 271/207 |
| 2008/0211158 | A1 * | 9/2008 | Fukasawa et al. | 270/1.01 |
| 2009/0243198 | A1 * | 10/2009 | Konishi | 271/221 |

FOREIGN PATENT DOCUMENTS

| | | | |
|---|---|---|---|
| JP | 01162657 | * | 6/1989 |
| JP | 8-67400 A | | 3/1996 |

OTHER PUBLICATIONS

Webster's New Basic Dictionary, 2007, Houghton Miffin Company, Office Edition, p. 755.*

Chinese Notification of the First Office Action dated Jul. 25, 2008 in Chinese Application No. 2006100825372, and English-language translation thereof.

* cited by examiner

*Primary Examiner* — Stefanos Karmis
*Assistant Examiner* — Patrick Cicchino
(74) *Attorney, Agent, or Firm* — Fitzpatrick, Cella, Harper & Scinto

(57) ABSTRACT

The invention provides a sheet processing apparatus in which a controller transports a sheet, delivered to a process tray, by a predetermined distance by a transport member for contacting a stopper, and selects the distance according to a friction on the lower surface of the sheet by detecting at least either of stack information on the process tray and sheet information of the sheet transported by the transport member, thus selecting the distance larger for a larger frictional force.

7 Claims, 31 Drawing Sheets

| FIG. 11A |
| --- |
| FIG. 11B |

FIG. 18A

PULLBACK FRICTION DRIVE LENGTH

| | SHEET SIZE | |
|---|---|---|
| | LESS THAN 279mm | 279mm OR MORE |
| PULLBACK LENGTH (SHEET-STACK NONE) | 35 | 40 |
| PULLBACK LENGTH (SHEET-STACK EXISTS) | 33 | 38 |

FIG. 18B

CROSS DIRECTION FRICTION DRIVE LENGTH

| | SHEET SIZE | |
|---|---|---|
| | LESS THAN 279mm | 279mm OR MORE |
| DRIVE LENGTH (SHEET-STACK NONE) | 1.12*Y | 1.20*Y |
| DRIVE LENGTH (SHEET-STACK EXISTS) | 1.05*Y | 1.10*Y |

| |
|---|
| FIG. 26A |
| FIG. 26B |
| FIG. 26C |

FIG. 31

OFFSET TRAVEL LENGTH OF OFFSET ROLLER (mm)

| | CORRECTION RATIO | SHEET SIZE | | | |
|---|---|---|---|---|---|
| | | A3 | B4 | A4 | B5 |
| SHEET TRAVEL LENGTH | | 10 | 30 | 53 | 67 |
| CORRECTION RATIO | | 1.2 | 1.1 | 1.0 | 1.0 |
| 1ST SHEET | 1.12 | 13.4 | 37.0 | 59.4 | 75.0 |
| 2ND SHEET OR LATER | 1.05 | 12.6 | 34.7 | 55.7 | 70.4 |

SHEET PROCESSING APPARATUS AND IMAGE FORMING APPARATUS

BACKGROUND OF THE INVENTION

1. Field of the Invention

The present invention relates to a sheet processing apparatus for receiving sheets, delivered from an image forming apparatus such as a copying apparatus, a printer, a facsimile apparatus or a composite apparatus, or from other office equipment, and stacking such sheets on a sheet stacking member, and an image forming apparatus incorporating or connected with the sheet processing apparatus, and more particularly to a technology for stably stacking sheets on a sheet stacking member.

2. Related Background Art

A sheet processing apparatus is already commercialized for receiving sheets delivered from an image forming apparatus such as a copying apparatus, a printer, or a facsimile apparatus and executing a sheet processing such as alignment, sorting, stacking, stapling, binding, punching or inspection. Also in certain types of the image forming apparatus, such sheet processing apparatus is incorporated or connected as an option for purchase.

A certain sheet processing apparatus is equipped, at an upstream side of a final stacking tray for stacking a sheet stack, with a process tray onto which sheets are delivered and stacked to form a sheet stack. The sheet stack is subjected to a processing such as a stapling on the processing stack member, and is then transferred from the process tray to the stacking tray and is stacked thereon.

In a sheet processing apparatus disclosed in Japanese Patent Application Laid-open No. H08-67400, a rear end impingement member is provided in an upstream side (rear end side of the conveyed sheet) on the process tray, and the sheets are driven at a lower surface thereof by a conveyor belt so as to impinge on the rear end impingement member, whereby the sheets are aligned in the conveying direction thereof.

In such sheet processing apparatus, a lateral end impingement member is provided at a side perpendicular to the conveying direction of the process tray (namely at a lateral side of the conveyed sheets) and the sheets are pushed by a pushing plate so as to impinge on the lateral end impingement member, whereby the sheets are aligned in the width direction thereof.

SUMMARY OF THE INVENTION

In such prior sheet processing apparatus described above, the process tray is inclined lower toward the rear end of the sheet, so that, by activating the conveyor belt toward the rear end of the sheet for a predetermined time, the sheet can almost securely impinge on the rear end impingement member without a skewed movement.

However, in order to guide the sheet to the rear end impingement member utilizing such inclination, it is necessary that at least the center of gravity of the sheet is positioned on the processing sheet and that a considerable area of the sheet is positioned on the process tray. Stated differently, in order to align A3-sized sheets, there is required a wide process tray somewhat larger than the A3 size. Such wide process tray, when positioned in an inclined state, inevitably increases the height of the aligning mechanism including the process tray. Therefore the sheet processing apparatus is difficult to realize in a thinner or smaller structure and cannot be incorporated in a compact desk-top printer.

Therefore, a technology is proposed to reduce the length of the process tray so as to position the center of gravity of the sheet outside the process tray, to press the sheet with a roller member from above to the process tray in such a manner that the sheet does not drop from the processing sheet, and to rotate such roller member thereby pulling back the sheet toward the upstream side. It is thus rendered possible, even without the inclination, to pull back the sheet to the upstream side thereby causing it to impinge on the rear end impingement member, and the process tray can be formed with a smaller area and in a horizontal position to realize a significant compactification of the sheet processing apparatus, thus enabling use thereof in a compact desk-top printer or the like.

There is also proposed a technology of sliding such rotatable roller member, in a stopped state, along the rotating axis thereof to entrain the sheet on the process tray by the friction, thereby moving the sheet in the transversal direction thereof causing it to impinge on the lateral end impingement member, whereby achieving the alignment in the transversal direction. Such technologies can achieve the rear end alignment and the lateral end alignment by a same roller member and allows to significantly reduce the number of component parts in comparison with the sheet processing apparatus disclosed in Japanese Patent Application Laid-open No. H08-67400, thereby enabling further compactification and cost reduction of the sheet processing apparatus.

In such sheet processing apparatus, a certain slippage is anticipated between the roller member and the sheet, so that, even when a skewed sheet impinges, at a side thereof, on the rear end impingement member (or lateral end impingement member), the sheet can rotate by such slippage with respect to the roller member whereby the skewed position can be corrected. Therefore, a rotation amount or a moving distance of the roller member is so selected as to provide a sheet travel slightly larger than the moving distance necessary for moving the sheet from the stopped position thereof on the process tray to the rear end impingement member (or lateral end impingement member).

However, such incremental distance, fixed constantly, may be unable to correct the skewing in a large sheet, even it can correct the skewing in a small sheet. Also it may be unable to correct the skewing in a sheet on which the roller member tends to cause a slippage, such as a first sheet in a stack or a coated paper. On the other hand, a constant increase in such incremental distance may cause a trace of friction, a crease or a bend on the sheet, or may result in a sheet travel by a repulsion of a bent sheet, thus leading to a drawback by the friction such as a distorted alignment when the roller member is disengaged.

In consideration of the foregoing, an object of the present invention is to provide a sheet processing apparatus capable, by optimizing a sheet conveying distance including a slippage, of correcting the skewing in necessary sufficient manner thereby precisely stacking the sheets, without aggravating the drawbacks of friction even with changes in a stacking status on the process tray, a sheet size and a sheet type.

The sheet processing apparatus of the present invention includes: a process tray on which a sheet is stacked; a stopper positioned adjacent to the process tray and configured to be in contact with the sheet delivered onto the process tray; a transport member configured to, in contact with a surface of the sheet, transport the sheet by a predetermined distance on the process tray and to cause the sheet to impinge on the stopper; and a controller configured to control the transport member and to determine the distance based on at least either of a sheet stacking status on the process tray and a sheet characteristic.

In the sheet processing apparatus of the present invention, the controller detects information on current stacking status in the process tray and information of a sheet to be aligned, and sets a transport length by the transport member according to a frictional force between the process tray and the sheet (more preferably a difference or a ratio in the frictional force between top and rear surfaces of the sheet). For example it sets a rotation amount of a roller, or a reciprocating movement distance thereof. The transport length means a sum of a sheet travel distance required for alignment and a predetermined slip distance.

More specifically, a large frictional force on the entire lower surface of the sheet increases a possibility that the transport member causes a slippage during the transporting operation and that the sheet becomes rotated to increase the necessary amount of alignment, so that the slip distance is increased in comparison with a case where the lower surface of the sheet has a smaller frictional force.

For example, a first sheet in a stack, having a friction between the sheet and the process tray, shows a frictional force larger than that in a second or subsequent sheet, which has a friction between the sheets. As the frictional force between the transport member and the sheet surface is constant, the transport distance is made larger for the first sheet than in the second or subsequent sheet.

Also for a larger sheet size, the frictional force increase due to increases in the weight of a sheet and in a frictional area, while the frictional force between the transport member and the sheet surface remains constant. Also an increase in the frictional force of the lower surface of the sheet may reduce a planar rotational angle of the sheet that can be corrected over a given transport distance, so that the transport length is increased in comparison with the case of a smaller sheet size.

Besides, for a larger sheet size, a skew amount of the sheet becomes larger for a given planar rotational angle of the sheet and may required a larger transport distance for absorbing such skew amount, so that, in consideration of the sheet size, the transport distance may be increased beyond the increasing rate of the frictional force.

It is therefore possible, in comparison with a case where the slip distance between the sheet and the transport member is fixed constantly, to optimize the transport distance and to correct a skewing in necessary sufficient manner thereby precisely stacking the sheets, without aggravating the drawbacks of friction even with changes in a stacking status on the process tray, a sheet size and a sheet type.

Other objects of the present invention, and advantages thereof, will become fully apparent from the following description which is to be taken in conjunction with the accompanying drawings.

BRIEF DESCRIPTION OF THE DRAWINGS

FIGS. 18A and 18B are charts explaining the setting of transport distance including slippage;

FIG. 31 is a chart showing a setting of an offset travel distance of the offset roller.

DETAILED DESCRIPTION OF THE PREFERRED EMBODIMENTS

In the following, a sheet processing apparatus constituting an embodiment of the present invention, and a copying apparatus, constituting an embodiment of the image forming apparatus equipped with such sheet processing apparatus, will be explained with reference to the accompanying drawings. However, the sheet processing apparatus of the present invention is not limited to a stapling process in the present embodiment but may also be so configured as to simply stack sheets on a sheet stacking member, or may further include a constitution for executing another process such as a punching process, or may be realized by a constitution for executing other processes only or another constitution for executing the same process. Also the image forming apparatus of the present invention is not limited to the copying apparatus shown in the embodiment but may also be realized as a facsimile apparatus, a printer or a composite apparatus thereof.

Also, a sheet processing apparatus 400 of the present embodiment may be connected to a printing apparatus or the like, other than a main body 500A of the copying apparatus 500. Also the sheet processing apparatus 400 of the present embodiment may be constructed in a separate casing separable from the main body 500A of the apparatus, or inseparably incorporated in the casing of the main body 500A.

In the following description, an upstream portion and a downstream portion of a transported sheet being respectively called a rear end and a front end; both lateral portions connecting the rear end and the front end of the sheet being called lateral ends; a distance between the lateral ends being called a width of the sheet; an alignment of the rear ends of sheets being called a rear end alignment; an alignment of the lateral ends of sheets being called a lateral end alignment; and an alignment of sheet widths being called a width alignment.

<Image Forming Apparatus>

Figure 1:
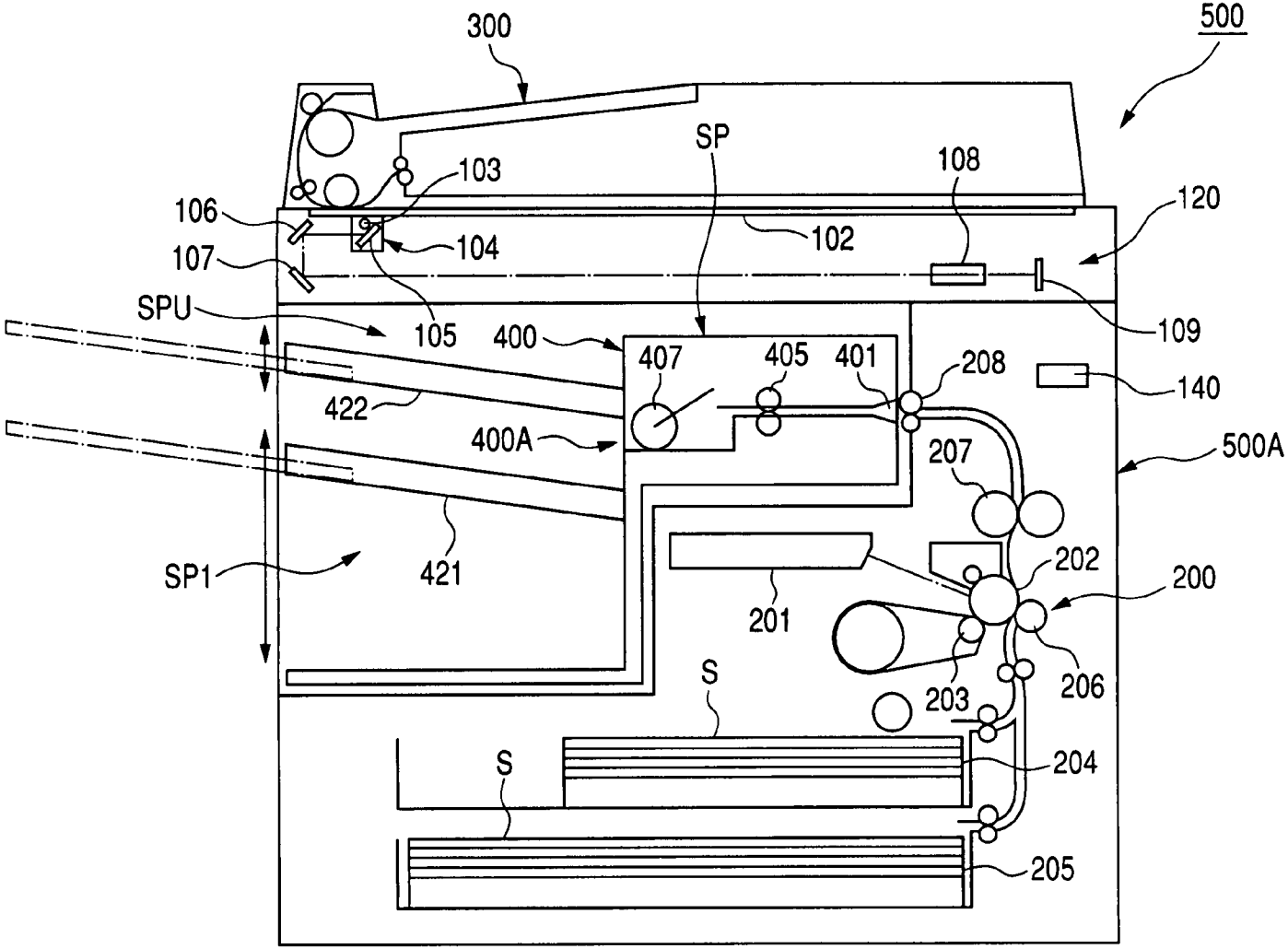
FIG. 1 is an elevation view of a copying apparatus equipped with a sheet processing apparatus constituting an embodiment of the present invention.

FIG. 1 is an elevation view of a copying apparatus equipped with a sheet processing apparatus constituting an embodiment of the present invention. The image forming apparatus of the present invention, for example a copying apparatus 500, is provided with a printer unit 200 constituting image forming means, and a sheet processing apparatus 400 constituting sheet processing means.

The copying apparatus 500 incorporates a reader portion 120 for reading an image of an original and a printer portion 200 for image formation within a main body 500A of the apparatus, and a sheet processing apparatus 400 for aligning and stapling sheets after image formation is positioned in a space SP provided in the main body 500A. On an upper part of the main body 500A, an automatic document feeder (hereinafter called "ADF") 300 for feeding documents one by one onto a platen glass 102 is mounted openably to the rear side.

The copying apparatus 500 functions not only as a copying machine for copying an original image, read in the reader portion 120, on a sheet by the printer portion 200, but also as a printer for receiving image data, transmitted for example from an external personal computer, in the printer portion 200 and printing an image on a sheet. Furthermore, the copying apparatus 500 functions as a facsimile apparatus for transmitting a facsimile signal of an original image, read by the reader portion 120, to another facsimile apparatus and for receiving a facsimile signal from another facsimile apparatus and printing it in the printer portion 200.

In case of copying images of plural originals, the originals are stacked on the ADF 300 and are conveyed one by one onto the platen glass 102 of the reader portion 120 and are passed above a stationary scanner unit 104. Also in case of copying an image of an original that cannot be handled by the ADF 300, the ADF 300 is opened to the rear, the original is placed on the platen glass 102 and the scanner unit 104 is moved in a lateral direction in the drawing. In either case, an image of a stripe-shaped area illuminated by a lamp of the scanner lamp 104 is focused, through mirrors 105, 106, 107 and a lens 108, onto a CCD image sensor 109, which reads a linear image for photoelectric conversion into an image signal, that is subjected to a digital process such as a conversion into image data and an image processing.

The image signal after digital process is transferred to an exposure control part 201 of the printer 200, and is converted into an optical signal by a modulated laser light. The exposure control part 201 scan irradiates a photosensitive drum 202 with the optical signal to form an electrostatic latent image on the surface of the photosensitive drum 202. The electrostatic latent image is developed by a toner deposition in a developing device 203, whereby a toner image is formed on the photosensitive drum 202.

In synchronization with the front end of the toner image, a sheet is conveyed from a sheet cassette 204 or 205, and the toner image is transferred onto the sheet S in a transfer part 206. The toner image transferred onto the sheet S is subjected to a pressure and a high temperature in a fixing part 207, thereby being fixed to the sheet S. The sheet S after fixation is transferred, through a sheet delivery part 208, to the sheet processing apparatus 400.

The sheet processing apparatus 400 is incorporated in a space SP, formed in a lateral part of the main body 500A of the apparatus 500, without overflowing from the main body 500A, and is capable of stacking a large amount of sheets, utilizing independently vertically movable stack trays 421, 422.

<Sheet Processing Apparatus>

Figure 2:
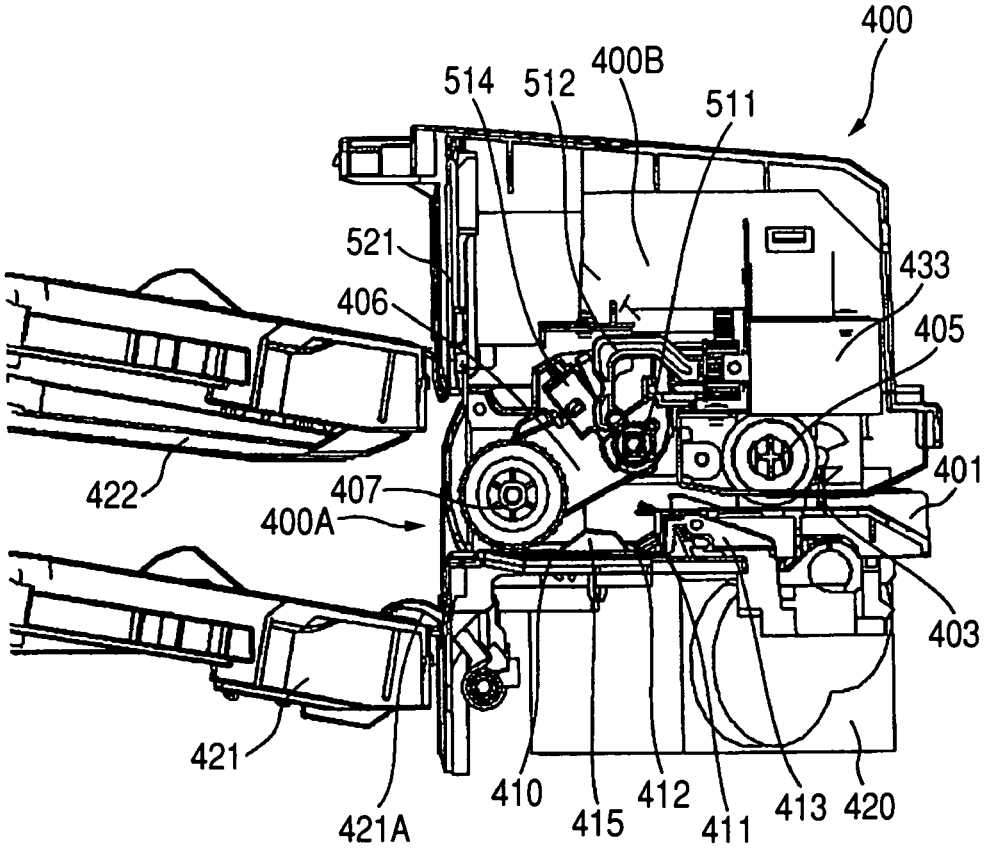
FIG. 2 is a partial cross-sectional view of the sheet processing apparatus.
Figure 3:
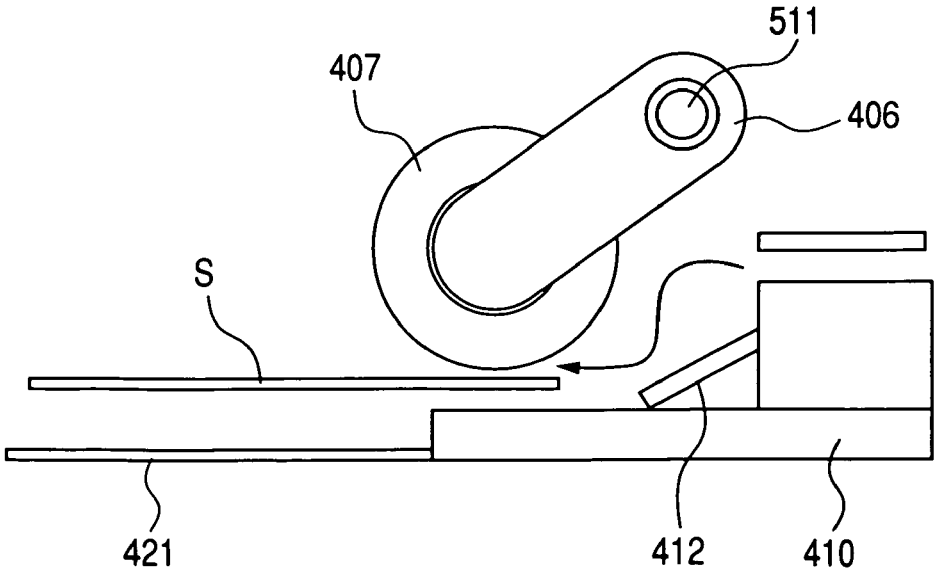
FIG. 3 is a schematic view of an offset roller.
Figure 4:
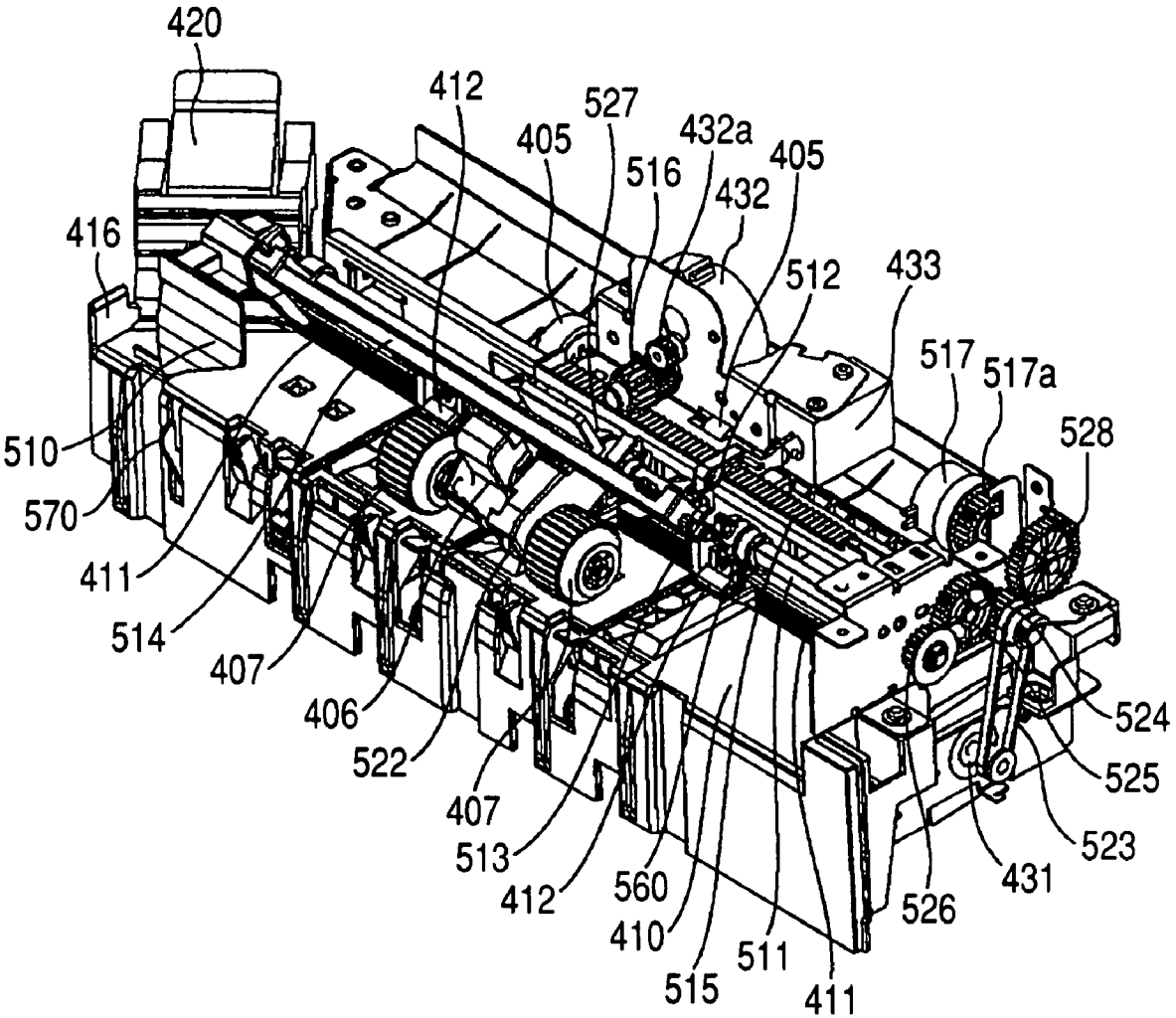
FIG. 4 is a perspective view of the sheet processing apparatus.
Figure 5A:
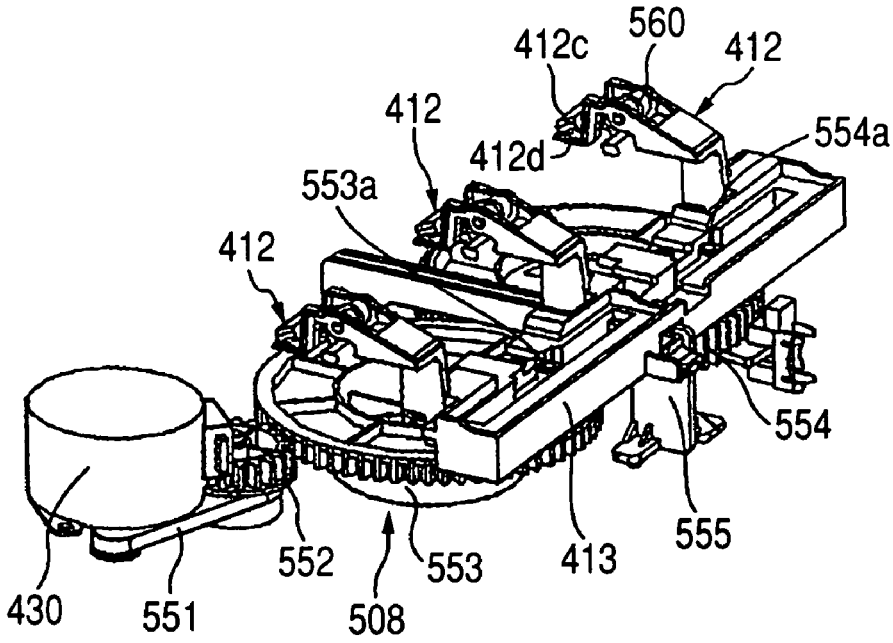
FIGS. 5A and 5B are views explaining a drive mechanism for a sheet delivery member.
Figure 5B:
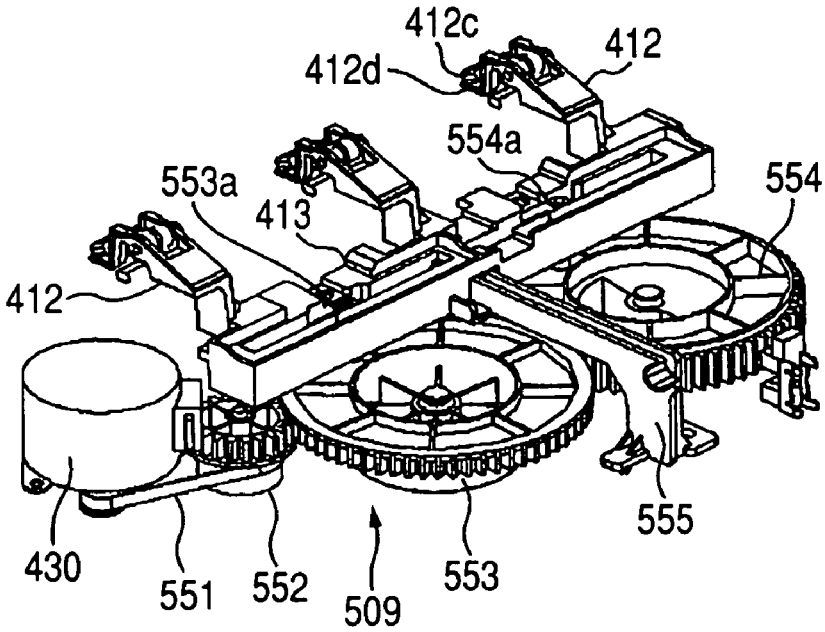
Figure 6:
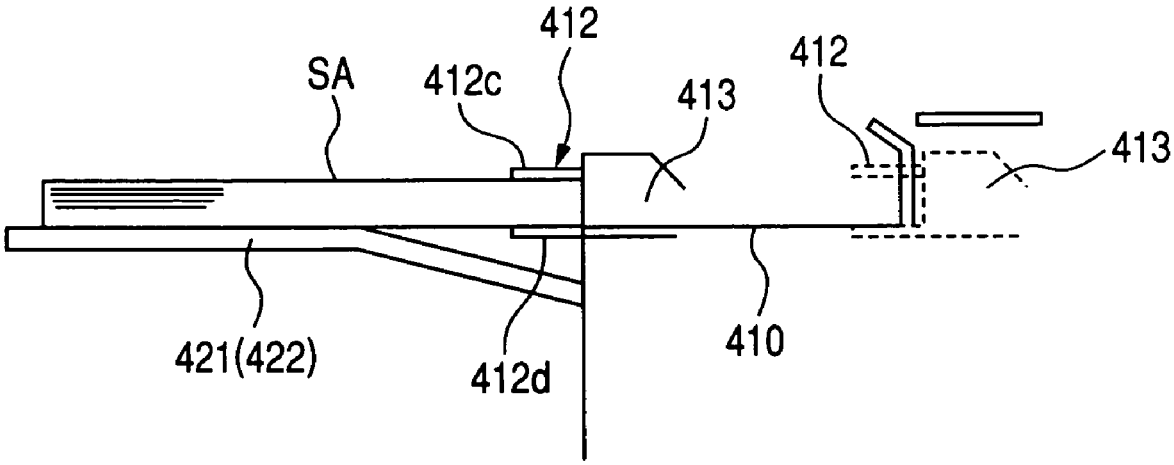
FIG. 6 is a schematic view showing a sheet stack delivery by a sheet stack delivery member.
Figure 7:
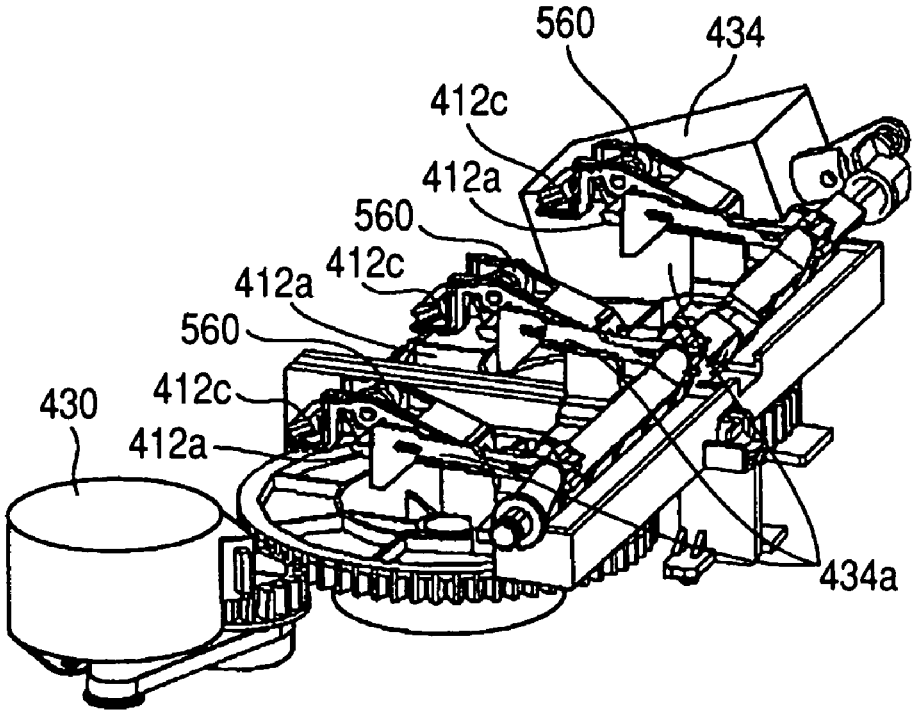
FIG. 7 is a schematic view explaining an open/close apparatus for a sheet clamp member.
Figure 8A:
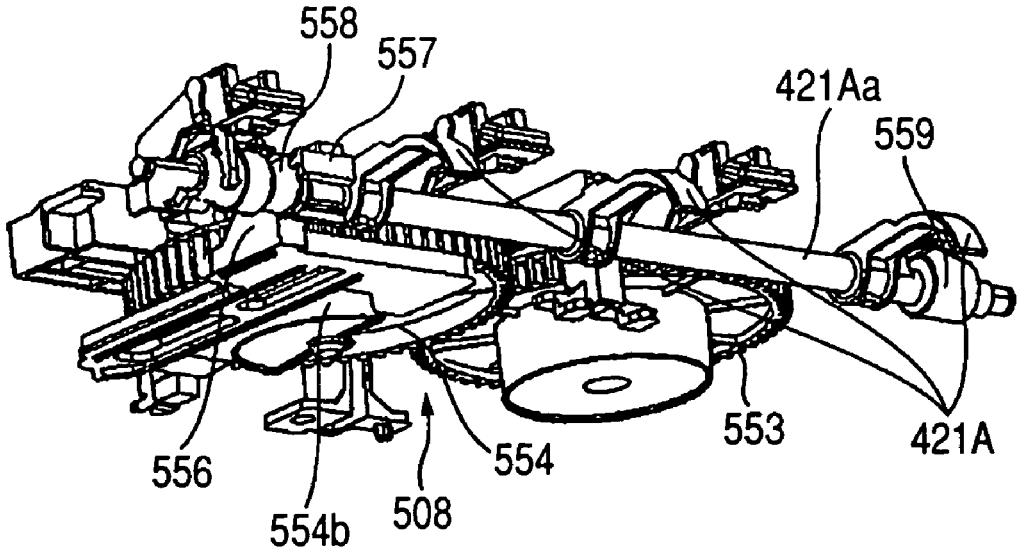
FIGS. 8A and 8B are views explaining a rotating apparatus for a pressure member.
Figure 8B:
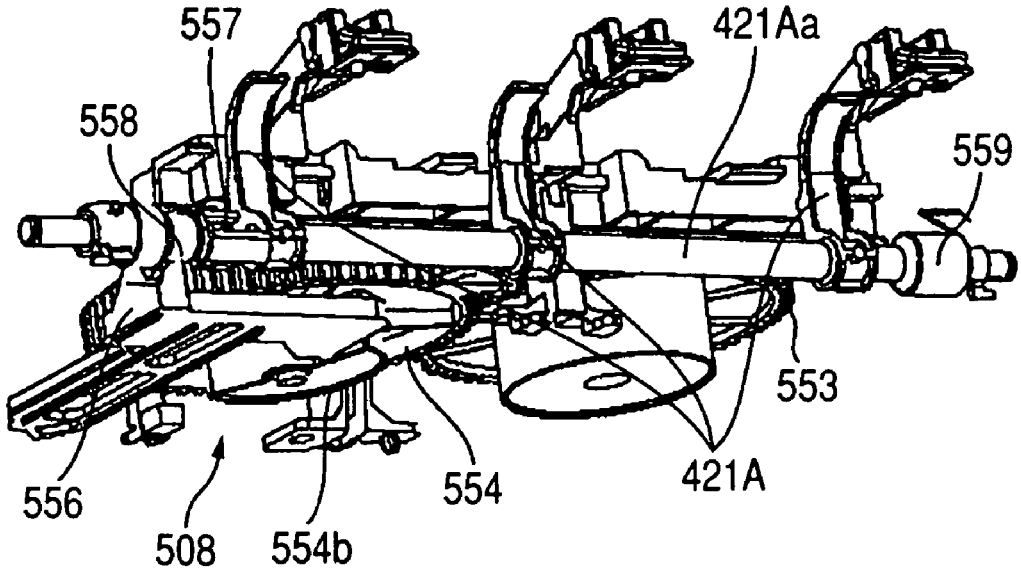
Figure 9:
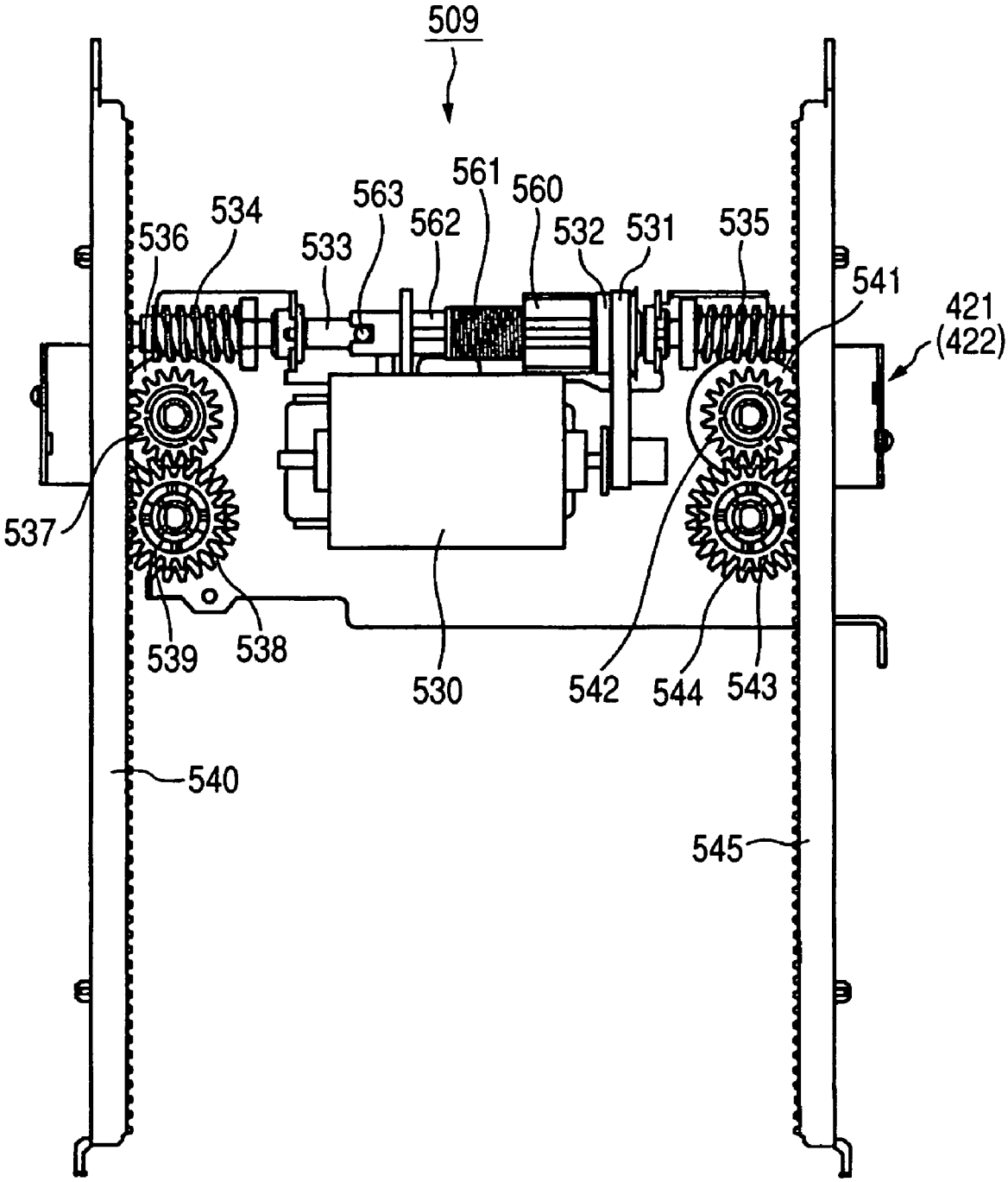
FIG. 9 is a schematic view of an elevator apparatus for a stack tray.

FIG. 2 is a partial cross-sectional view of the sheet processing apparatus; FIG. 3 is a schematic view of an offset roller; FIG. 4 is a perspective view of the sheet processing apparatus; FIGS. 5A and 5B are views explaining a drive mechanism for a sheet delivery member; FIG. 6 is a schematic view showing a sheet stack delivery by a sheet stack delivery member; FIG. 7 is a schematic view explaining an open/close apparatus for a sheet clamp member; FIGS. 8A and 8B are views explaining a rotating apparatus for a pressure member; and FIG. 9 is a schematic view of an elevator apparatus for a stack tray.

The sheet processing apparatus of the present embodiment is provided with a process tray 410 as a processing stack member, a transport roller 405 as a delivery member, a sheet rear end stopper 411 as a rear end impingement member, a width direction positioning wall 416 as a lateral end impingement member, an offset roller 407 as transport means, a CPU 100 as control means, an offset roller 407 as a roller member, a sheet delivery member 413 as sheet stack delivery means, and a sheet clamp member 412 as sheet clamping means.

The sheet processing apparatus 400 is equipped, as shown in FIG. 2, with a process tray 410 for temporarily stacking sheets delivered in succession from the main body 500A (FIG. 1), and a stack tray (lower bin) 421 and a stack tray (upper bin) 422 for finally stacking the sheet stack formed on the process tray 410. The stack trays 421, 422 are independently moved in the vertical direction, and are used for sorted stacking in case of a printer or facsimile output other than a copy job. The process tray 410 stacks sheets by a sheet switchback utilizing an offset roller 407.

A sheet receiving part 401 receives a sheet delivered from the main body 500A of the apparatus. The sheet received by the sheet receiving part 401, after being detected by an entrance sensor 403, is transported by a transport roller 405 and an offset roller 406, to the process tray 410 and stacked thereon. The process tray 410 is provided in a sheet process part 400B for processing the sheet. The sheet stacked on the process tray 410 is detected by a sheet stack delivery sensor 415.

The offset roller 407 is a roller member for transporting the sheet by a forward rotation, a reverse rotation or an offset travel (axial travel), and is constituted of a pair of cylinders each having an external peripheral part formed by an elastic member of a rubber-like elasticity such as rubber or a foamed member. The offset roller 407 is supported, as shown in FIG. 3, by an offset roller holder 406 rotatable about an offset axis 511.

The offset roller holder 406 is so supported as to be movable along the offset axis 511 (in the width direction of the sheet), and is vertically rotated by means of a pickup solenoid 433, a solenoid arm 512, a lever holder 513, a separation lever 514 and the offset roller holder 406, whereby the offset roller 407 is elevated or lowered in response to on/off operation of the pickup solenoid 433. When the pickup solenoid 433 is turned off by a detection signal indicating that the rear end of the sheet has passed the entrance sensor 403, as shown in FIG. 2, the offset roller 407 rotating in the forward direction descends by the weight thereof and contacts the sheet. The offset roller 407, after transporting the sheet toward the downstream side in the sheet transporting direction, is reversed to pull back the sheet toward the upstream side, thereby causing the rear end of the sheet to impinge on a sheet rear end stopper 411, standing at the upstream end of the process tray 410.

The offset roller 407 is rotated by a transport motor 431, which also drives the transport roller 405 (FIG. 2), through a timing belt 523, a roller gear 524, an idler gear 525, an offset gear 526, an offset pulley 527 and a timing belt 522. The offset roller 407 rotates, according to the rotating direction of the transport motor 431, in the forward direction to transport the sheet toward the downstream side or in the reverse direction to transport the sheet toward the upstream side.

The offset roller 407 also moves in the width direction of sheet, by the drive of an offset motor 432 capable of forward or reverse rotation, thereby approaching or being separated from the width direction positioning wall 416. Rotation of the offset motor 432 is transmitted to an offset motor gear 432*a* and an offset pinion 516, and is converted by an offset track 515 into a linear motion along the offset axis 511.

The transport motor 431 and the offset motor 432 are constituted of stepping motors, of which rotation amounts can be controlled by a number of input pulses supplied to the respective drivers. More specifically, a pullback amount of the sheet is controlled by a number of input pulses to the driver of the transport motor 431, and an offset travel amount of the sheet is controlled by a number of input pulses to the driver of the offset motor 432.

The sheet, subjected to the rear end alignment by impinging on the sheet rear end stopper 411, is displaced, as being entrained by the frictional force of the contacting offset roller 407 when the no longer rotating offset roller 407 approaches the width direction positioning wall 416, and goes under a sheet press member 510. Thus the sheet is curl corrected by the sheet press member 510, and impinges on the width direction positioning wall 416 thereby aligned at the lateral end. Even after the sheet S impinges on the width direction positioning wall 416, the offset roller 407 moves toward the width direction positioning wall 416 by a predetermined amount, sliding on the sheet, and is then stopped.

At a rear side of the process tray 410, a sheet stack delivery member 413 shown in FIGS. 5A to 8B and a drive apparatus therefor are provided. The sheet stack delivery member 414 pinches a rear end portion of a processed sheet stack by a sheet clamp member 412, and pushes and delivers the stack to the stack tray 421 or 422.

In the sheet stack delivery member 413, as shown in FIG. 5A, the sheet clamp member 412 has a freely rotatable upper claw 412*c*, which is biased by a biasing part 560 and can be opened from or closed to a lower claw 412*d*. The sheet stack delivery member 413, by a travel along a slide rail 555 from a position shown in FIG. 5A to a position shown in FIG. 5B, displaces an aligned sheet stack (or an aligned and stapled sheet stack) SA toward the stack tray 421 (or 422) waiting at the downstream side of the process tray 410 while the stack is supported by the sheet clamp member 412.

The sheet stack delivery member 413 stops upon reaching a sheet delivery position indicated by a solid line in FIG. 6, namely the front end part of the process tray 410, then opens the upper claws 412*c* and returns toward the sheet rear end stopper 411. Thus, the sheet stack SA released from the sheet clamp members 412 drops to the tray 421 (or 422). The sheet stack SA, delivered to the stack tray 421 (or 422) is pressed, at a rear end portion, by a press member 421A (FIG. 2) to be explained later, to the stack tray 421 (or 422).

Now referring to FIG. 7, when the clamp solenoid 434 is turned on, the upper claw 412*c* is activated through a lever 434*a* and a releasing lever 412*a*, and rotate upward against the biasing force of the biasing part 560. The clamp solenoid is turned on when the offset roller 407 is stopped after transporting the sheet to the downstream side, and when the offset roller 407 moves in the width direction.

Referring to FIGS. 5A and 5B, pins 553*a*, 554*a* move along an unillustrated guide slit formed in the sheet stack delivery member 413, thus reciprocates along the process tray 410. The pin 553*a* (554*a*) is fixed on a slide gear 553 (554) which is driven by the sheet stack delivery motor 430 through a belt 551 and a pulley gear 552.

When the sheet stack delivery motor 430 rotates, the sheet stack delivery member 413 reciprocates, along the guide rail 555, between the position for delivering the sheets to the stack tray 421 (or 422) as shown in FIG. 5B and a home position close to the sheet rear end stopper 411 as shown in FIG. 5A. Normally, the sheet stack delivery member 413 is positioned and stopped at the home position by energization of the sheet stack delivery motor 430.

Referring to FIG. 8A, when the slide gear 554 rotates, a cam 554*b* provided thereunder displaces a press member 556 in the sheet transporting direction. Then a lever member 557 converts the travel in the sheet transporting direction into a rotation, of which driving power is transmitted through a coil spring 558 to a shaft portion 421A*a*, which rotates the pressing member 421A downwards. On the other hand, when the cam 554*b* is released from the press member 556 as shown in FIG. 8B, the press member 421A is released, by a returning coil spring 559, from the stacking face of the stack tray 421 (422) and is retracted upwards.

In the course of sheet stack delivery by the sheet stack delivering member 413, the cam 554*b* displaces the press member 556 in the sheet transporting direction and rotates the pressing member 421A downwards, whereby the sheet stacked on the stack tray 421 (422) is not entrained by the delivered sheet stack.

Then, as shown in FIG. 5B, when the slide gear 553 (554) driven by the sheet stack delivery motor 430 is rotated whereby the sheet stack delivery member 413 reaches the position of delivering the sheet stack to the stack tray 421 (422), the press member 556 is released from the pressing action by the cam 554*b*, as shown in FIG. 8B. In this state, the press member 421A is released, by the returning coil spring 559, from the sheet on the stack tray 421 (422) and is retracted in a space under the process tray 410 (FIG. 4), in order not to obstruct the dropping of the sheet stack onto the stack tray 421 (422).

Now, reference is made to FIG. 9 for explaining an elevator apparatus 509 for the stack tray 421. An elevator apparatus 509 for the stack tray 422 is constructed in a similar manner, and will not, therefore, be explained in detail.

As shown in FIG. 9, rotation of a stack tray elevating motor 530 is transmitted, through a belt 531, a pulley 532 and a rotary shaft 533, to worm gears 534, 535 at both ends. Rotation of the worm gear 534 (535) is transmitted through a worm wheel 536 (541), a gear 537 (542) formed integrally with the worm wheel 536 (541), and a gear 538 (544), and is further transmitted as a linear movement from the gear 538

(544) to a rack 540 (545). Thus the stack tray 421 is elevated or lowered by a relative movement of a gear 539 (543) relative to the racks 540, 545.

On a clutch 560 rotating in linkage with the pulley 532, there is wound an end of a coil spring 561 of which the other end is wound on a clutch 562, of which a groove engages with a pin 563 pressed in the rotary shaft 533. By means of such structure, the driving power of the pulley 532 is transmitted from the clutch 560 to the clutch 562 through the coil spring 561, and further transmitted through the pin 563 to the rotary shaft 533, thereby driving worm gears 534, 535 on both ends. The clutches 560, 562 and the coil spring 561 constitute a certain torque limiter, in which, when the elevating load of the stack tray 421 becomes excessively large, the connections between the clutches 560, 562 and the coil spring 561 cause a slippage, whereby the stack tray 421 is not elevated further.

<Control of Sheet Processing Apparatus>

Figure 10:
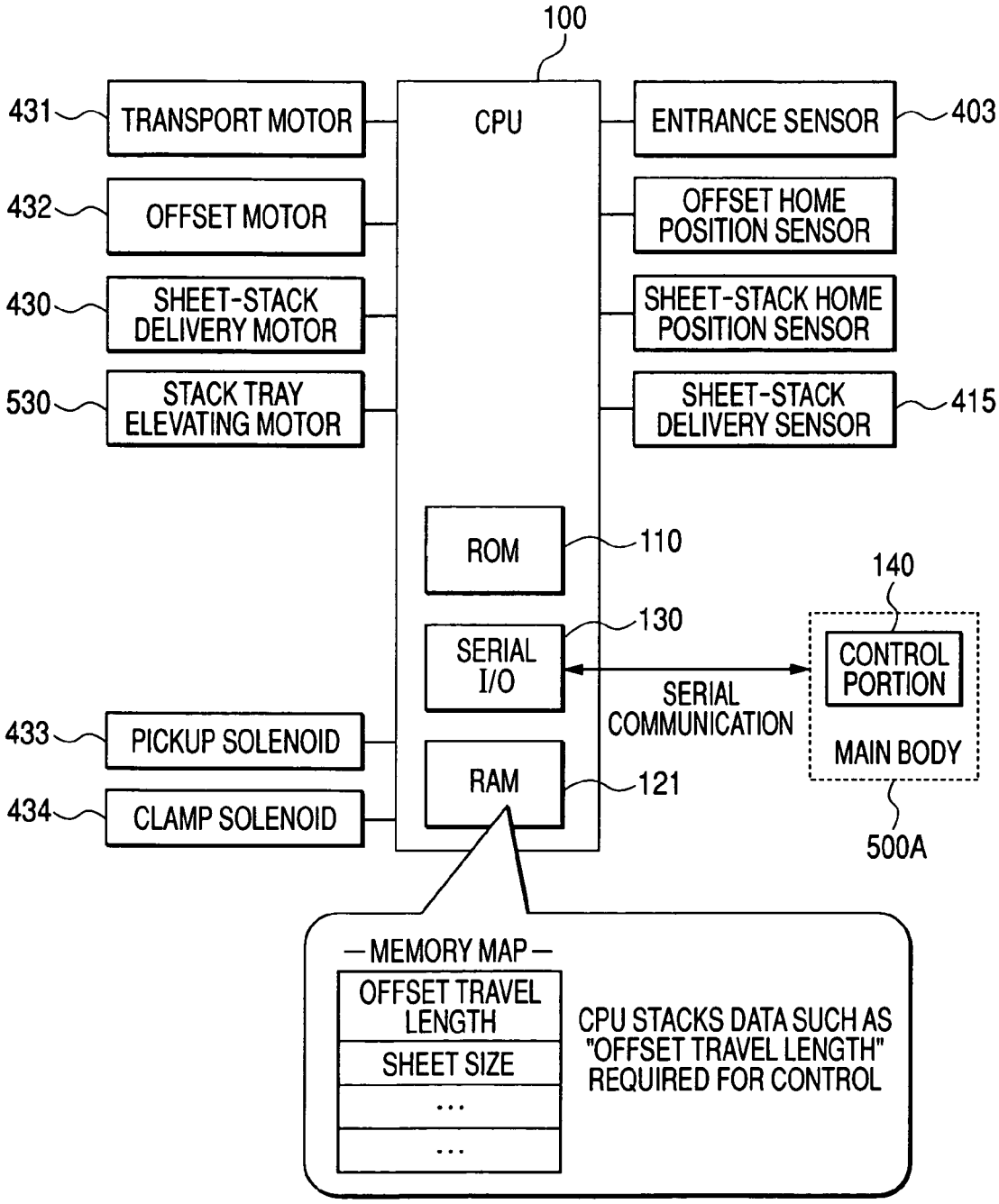
FIG. 10 is a block diagram showing constitution of a controller of the sheet processing apparatus.
Figures 11, 11A:
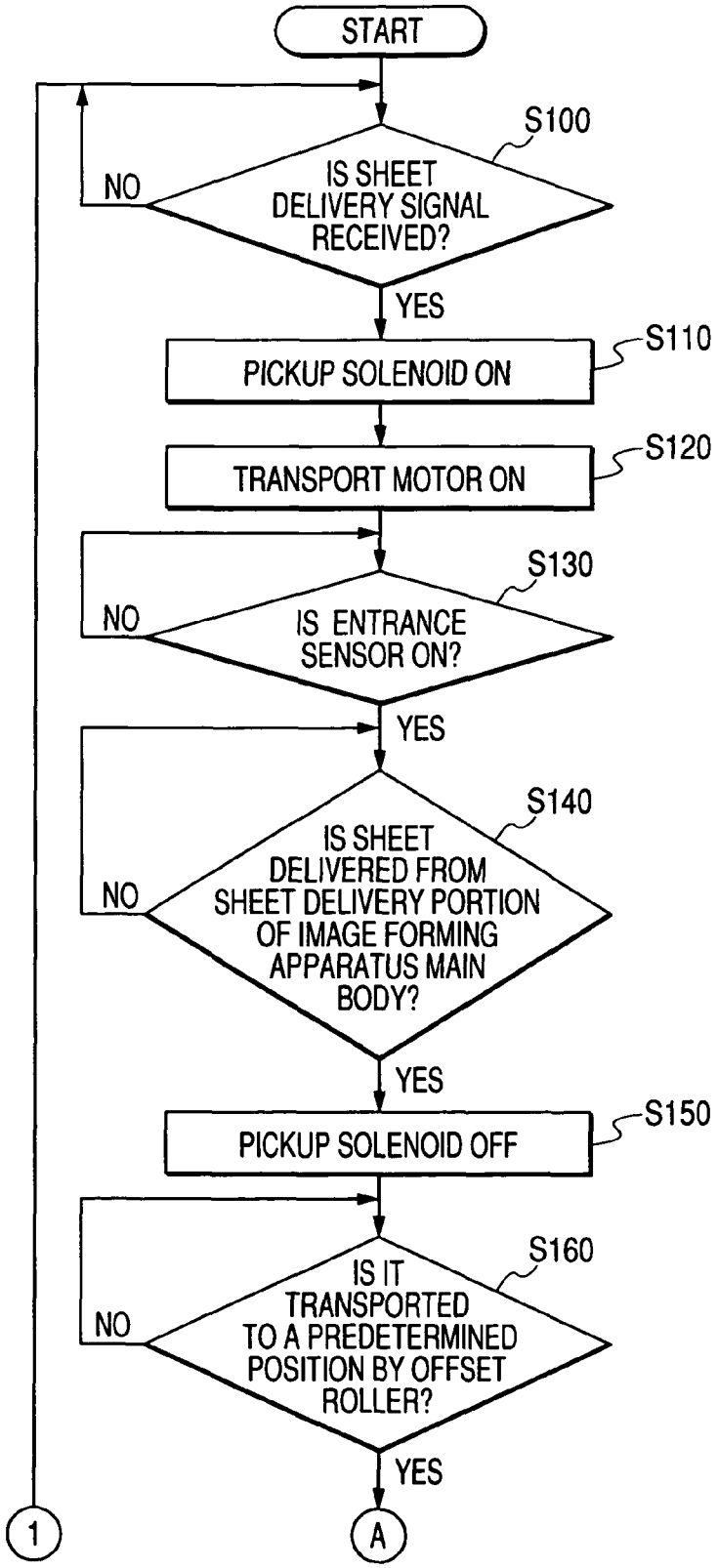
FIG. 11 which is composed of FIGS. 11A and 11B are front half of control flow charts for the sheet processing apparatus.
Figure 12:
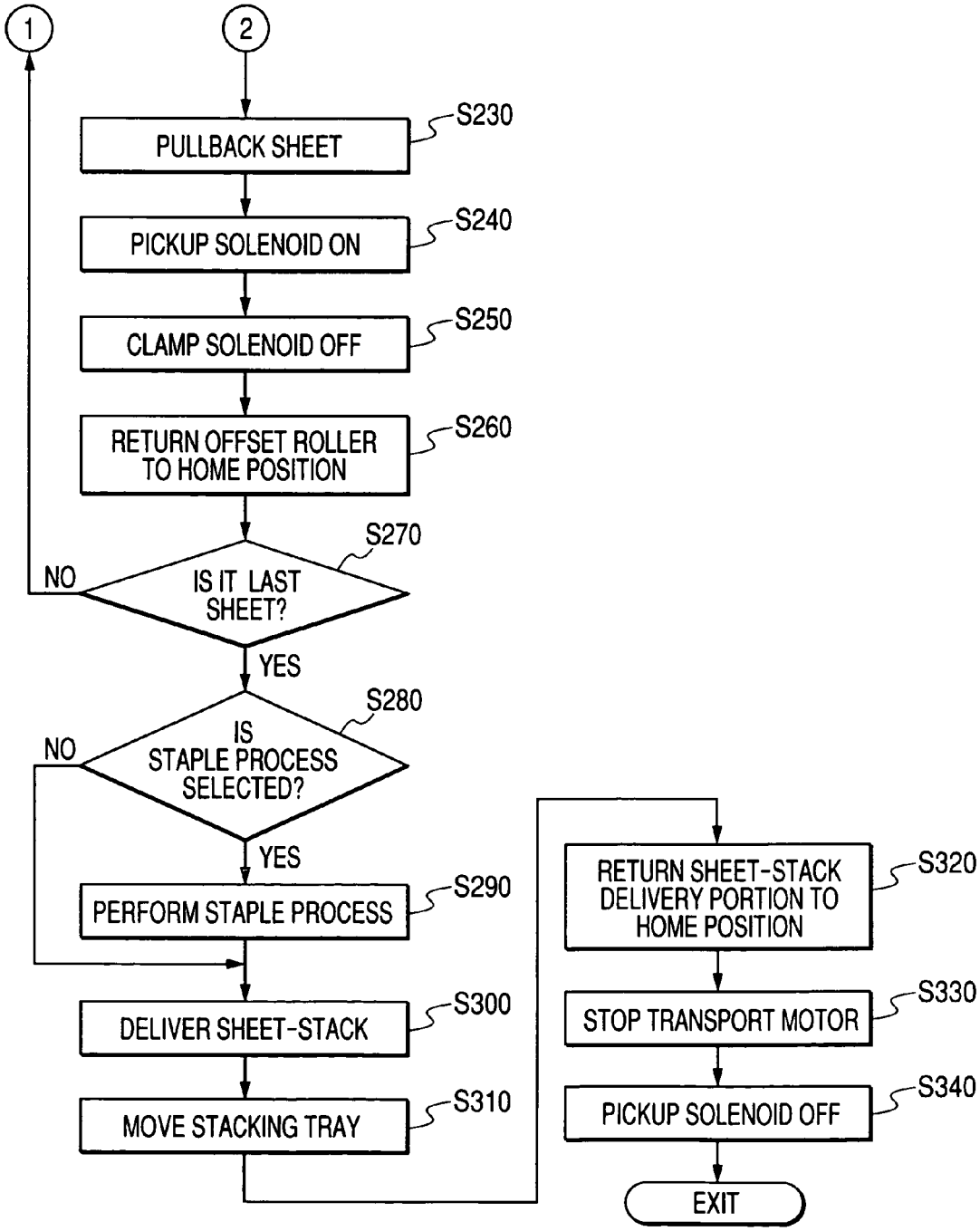
FIG. 12 is a rear half of the control flow chart for the sheet processing apparatus.
Figure 13A:
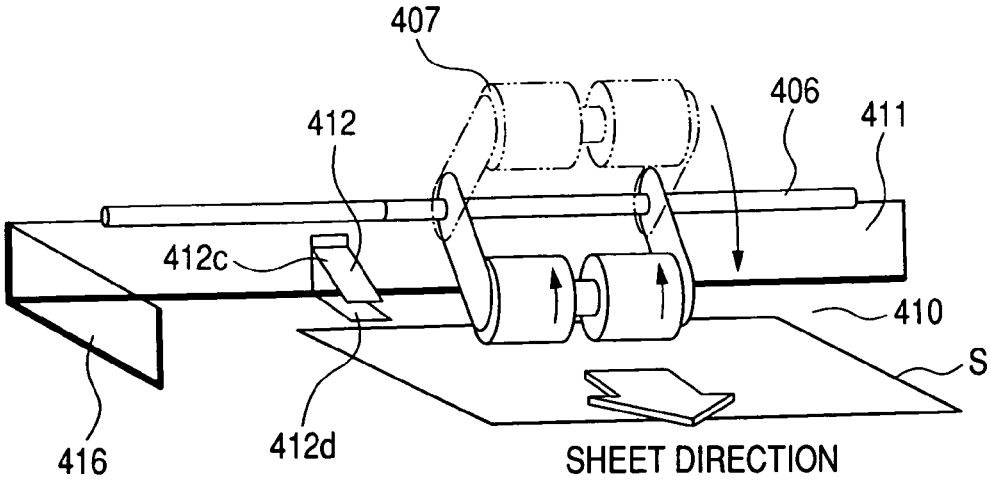
FIGS. 13A, 13B and 13C are schematic views explaining a rear end alignment and a lateral end alignment of the sheet.
Figure 13B:
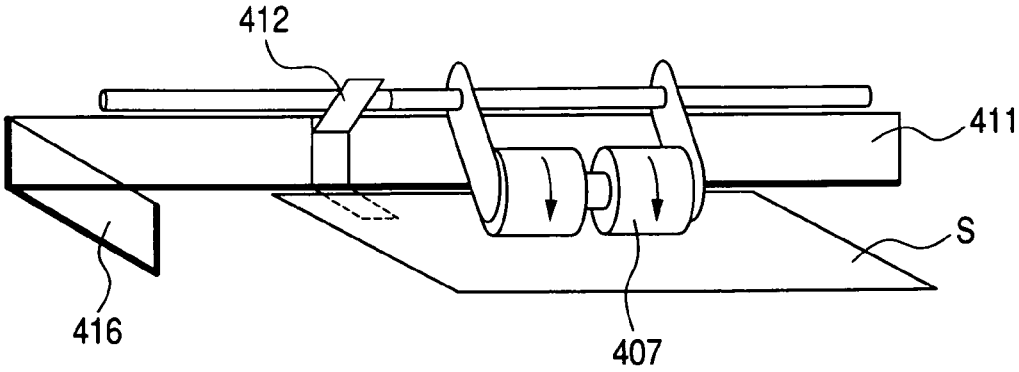
Figure 13C:
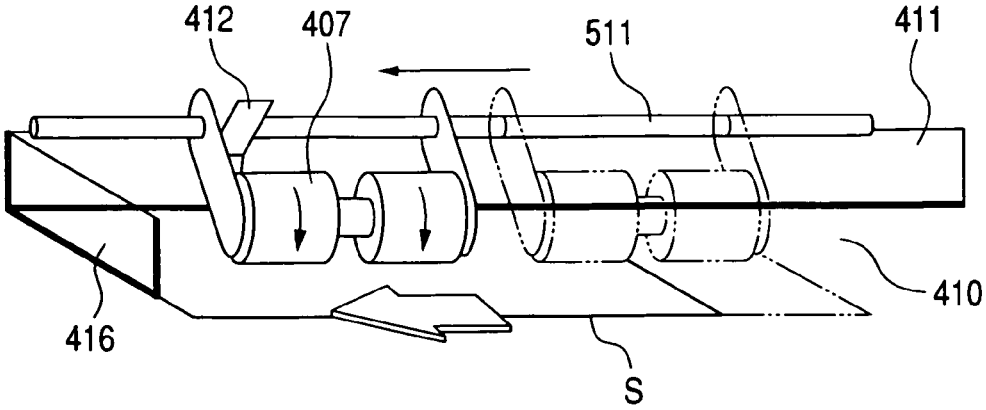
Figure 14A:
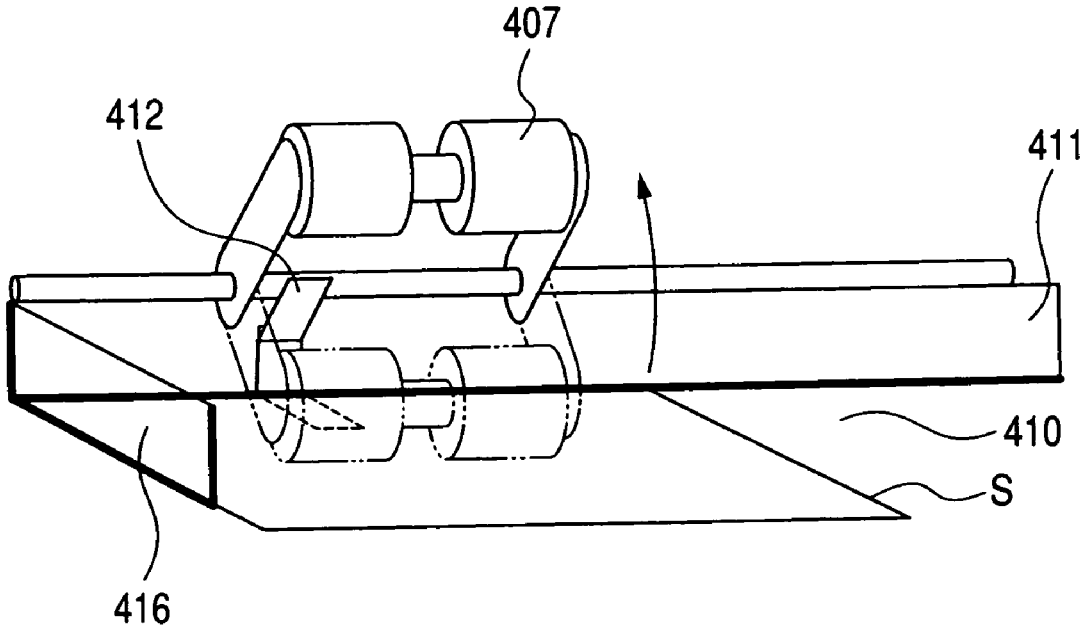
FIGS. 14A and 14B are schematic views explaining a home positioning of the offset roller.
Figure 14B:
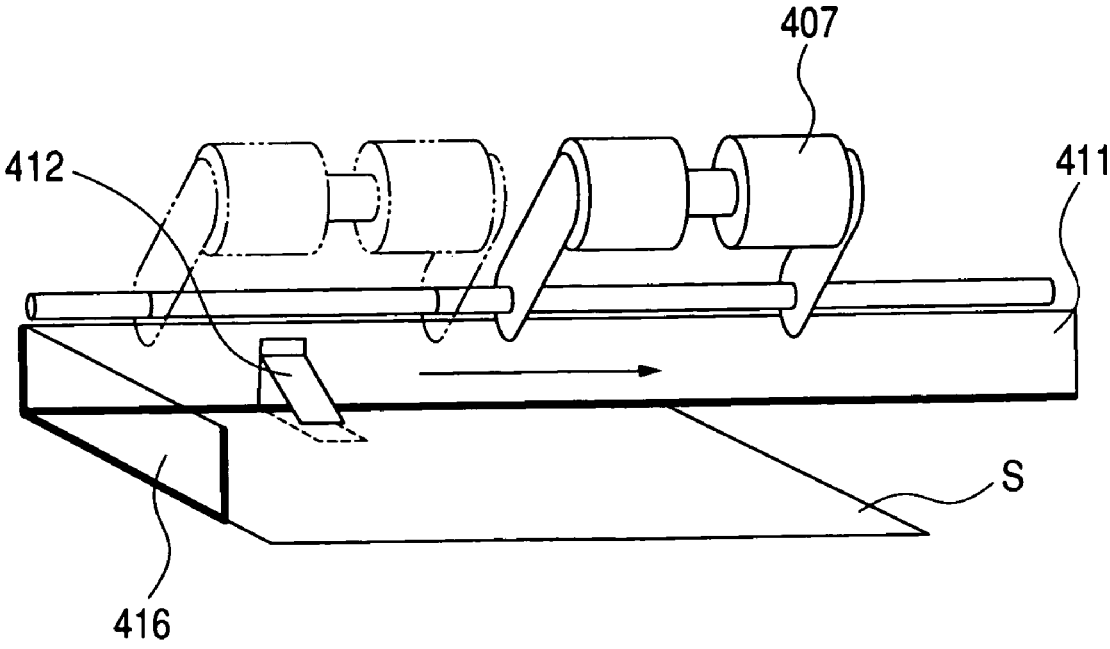
Figure 15A:
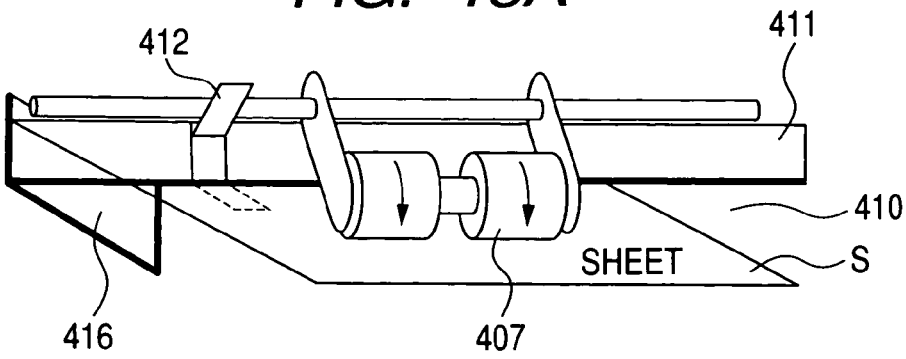
FIGS. 15A and 15B are schematic views explaining open/close operations of the sheet clamp member.
Figure 15B:
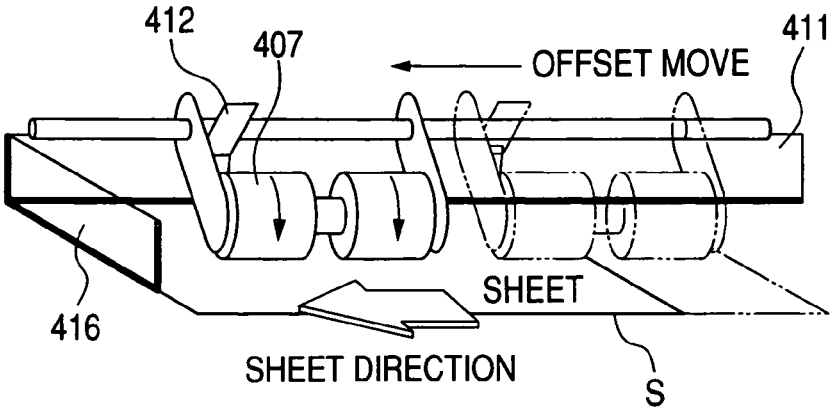
Figure 16:
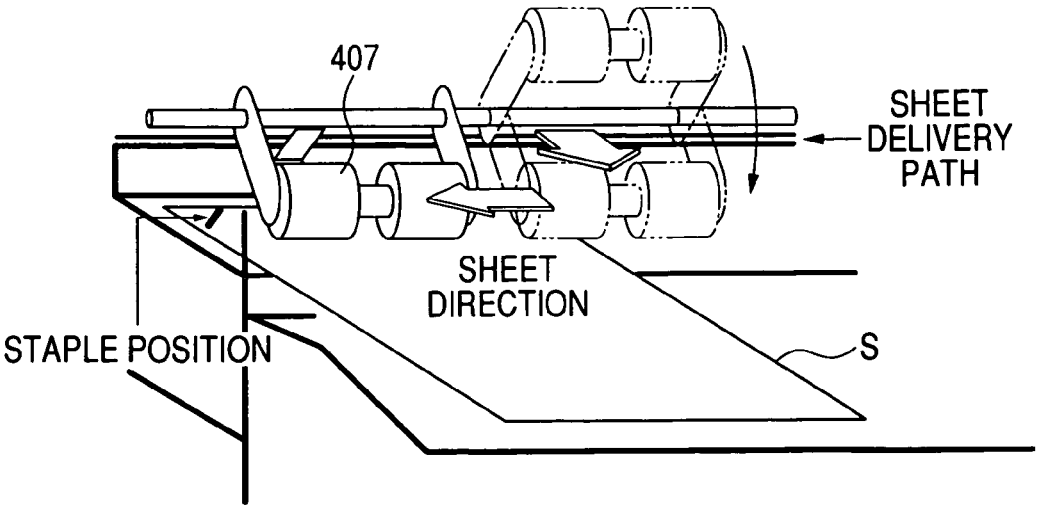
FIG. 16 is a view showing a stapling position.
Figure 17A:
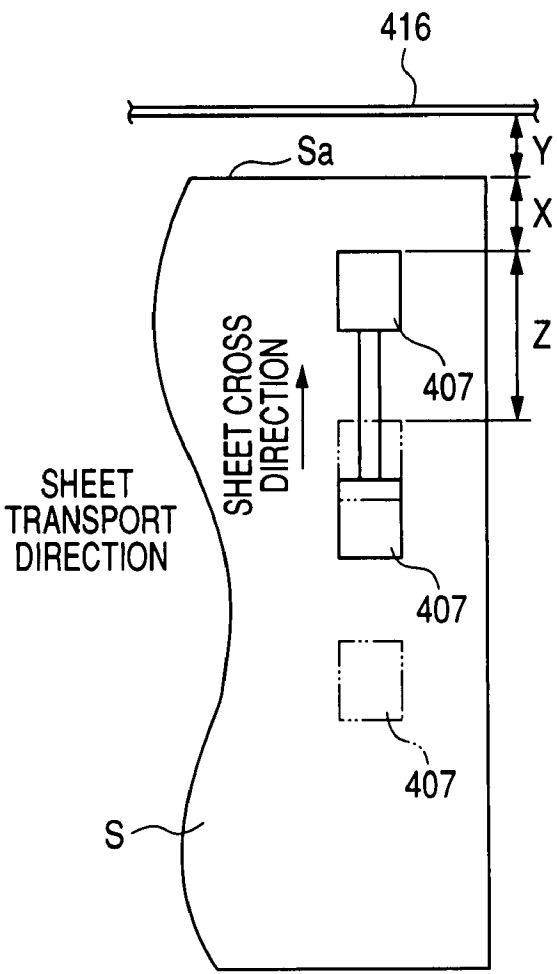
FIGS. 17A, 17B and 17C are schematic views explaining a travel distance of the offset roller in a lateral end alignment.
Figure 17B:
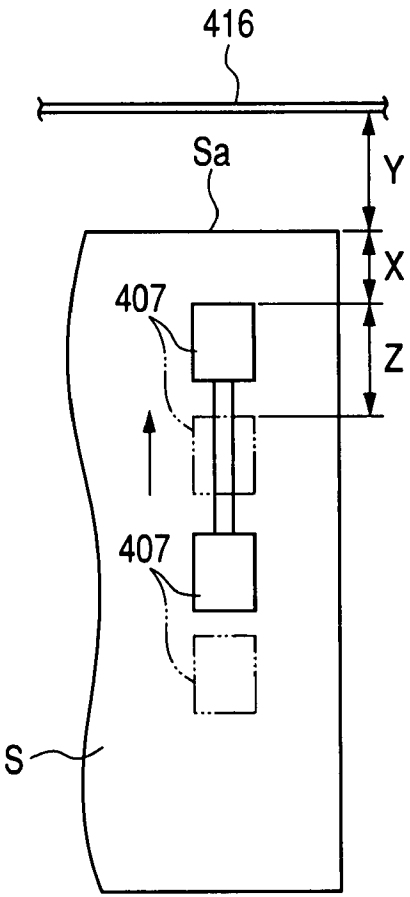
Figure 17C:
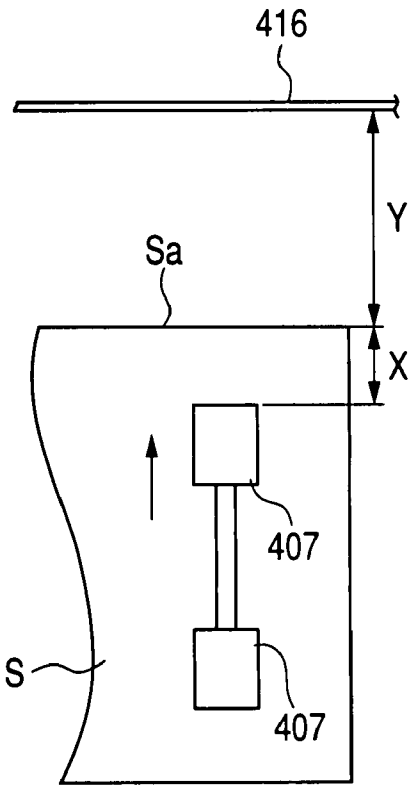

FIG. 10 is a block diagram showing constitution of a controller of the sheet processing apparatus 400; FIGS. 11 and 12 are control flow charts of the sheet processing apparatus; FIGS. 13A, 13B and 13C are schematic views explaining a rear end alignment and a lateral end alignment of the sheet; FIGS. 14A and 14B are schematic views explaining a home positioning of the offset roller; FIGS. 15A and 15B are schematic views explaining open/close operations of the sheet clamp member; FIG. 16 is a view showing a stapling position; FIGS. 17A, 17B and 17C are schematic views explaining a travel distance of the offset roller in a lateral end alignment; and FIG. 18A and 18B are charts explaining the setting of transport distance including slippage.

As shown in FIG. 10, a CPU 100 constituting a microcomputer system is provided therein with a ROM 110, a RAM 121, and a serial interface 130. The ROM 110 stores process programs corresponding to the control sequences of flow charts shown in FIGS. 11 and 12, and in the RAM 121, a process program read from the ROM 110 is held, and operational data, input data, communication data, calculation results etc. generated in the course of control sequence are stored and erased.

The serial interface 130 exchanges control data with a control part 140 of the main body 500A of the apparatus, and is also capable of bidirectional communication with another computer or a fax receiving part (not shown).

Sensors such as an entrance sensor 403 and a sheet stack delivery sensor 415 are connected to input ports of the CPU 100. Also output ports thereof are connected to motors and solenoids, such as the transport motor 431, the offset motor 432, the sheet stack delivery motor 430, the stack tray elevating motor 530, the pickup solenoid 433 and the clamp solenoid 434.

The CPU 100 reads the process program from the ROM 110, holds it in the RAM 121, and controls various parts of the sheet processing apparatus 400 by monitoring the outputs of these sensors according to the process program, executing necessary operations based on the control data transmitted from the control part 140 of the main body 500A and controlling these motors and solenoids.

As the control part 140 of the main body 500A understands the size of the sheet delivered from the sheet delivery part 208, the CPU 100, for each delivery of the sheet S from the main body 500A, executes a serial communication with the control part 140 of the main body 500A to recognize the size of the sheet stacked on the process tray 410, and sets a travel amount (=sheet travel amount+slip amount) of the offset roller 407 in the width direction of the sheet corresponding to the sheet size, thereby controlling the offset motor 432.

The CPU 100 controls a number of pulses entered into the driver of the transport motor 431 thereby controlling a pullback amount of the sheet by the offset roller 407, and also controls a number of pulses entered into the driver of the offset motor 432 thereby controlling an offset travel amount of the offset roller.

As will be explained later, the CPU 100, according to presence/absence of the stacked sheet on the process tray 410 and the sheet size, sets a transport distance in a pullback direction by the offset roller 407 in a transport distance counter, and also sets an offset travel amount of the offset roller 407 in a travel amount counter. Then, when a pullback operation of the sheet is started, the transport distance counter is decremented and the offset roller 407 is stopped when the transport distance counter reaches 0. Also when an offset travel of the offset roller 407 is started, the travel amount counter is decremented and the offset travel is terminated when the travel amount counter reaches 0. In this manner the sheet rear end securely impinges on the sheet rear end stopper 411, and then the lateral end of the sheet securely impinges on the width direction positioning wall 416.

At every stacking of a predetermined number of sheets on the stack tray 421 (422) or at every stacking of a sheet stack, the CPU 100 lowers the stack tray 421 (422) to turn off a sheet surface sensor 573, then immediately elevates the stack tray 421 (422) and stops it at a height where the sheet surface sensor 573 is turned on. In this manner the stack tray 421 (422) is lowered by the thickness of the immediately previously stacked sheets, whereby the uppermost surface of the stacked sheets (stacked surface) is maintained at a substantially constant height.

When stacking sheets on the process tray 410, the CPU 100 elevates the stack tray 421 (422) to such a height that the uppermost surface of the stacked sheets (stacked surface) substantially matches the process tray 410, thereby causing the front end part of the sheet stacked on the process tray 410 to be supported by the uppermost surface of the stacked sheets (stacked surface), whereby, even when the sheet clamp member 412 is opened, the stacked sheet does not slip onto the stack tray 421 (422).

Now operations and control of various mechanisms, explained in FIGS. 1 to 10, will be explained according to flow charts shown in FIGS. 11 and 12, making reference to FIGS. 13A to 16 for explaining operations. The offset roller 407 shown in FIGS. 13A to 16 is positioned between a pair of offset roller holders 406, but is not different in operation and function from the offset roller 407 shown in FIG. 4.

Figure 11B:
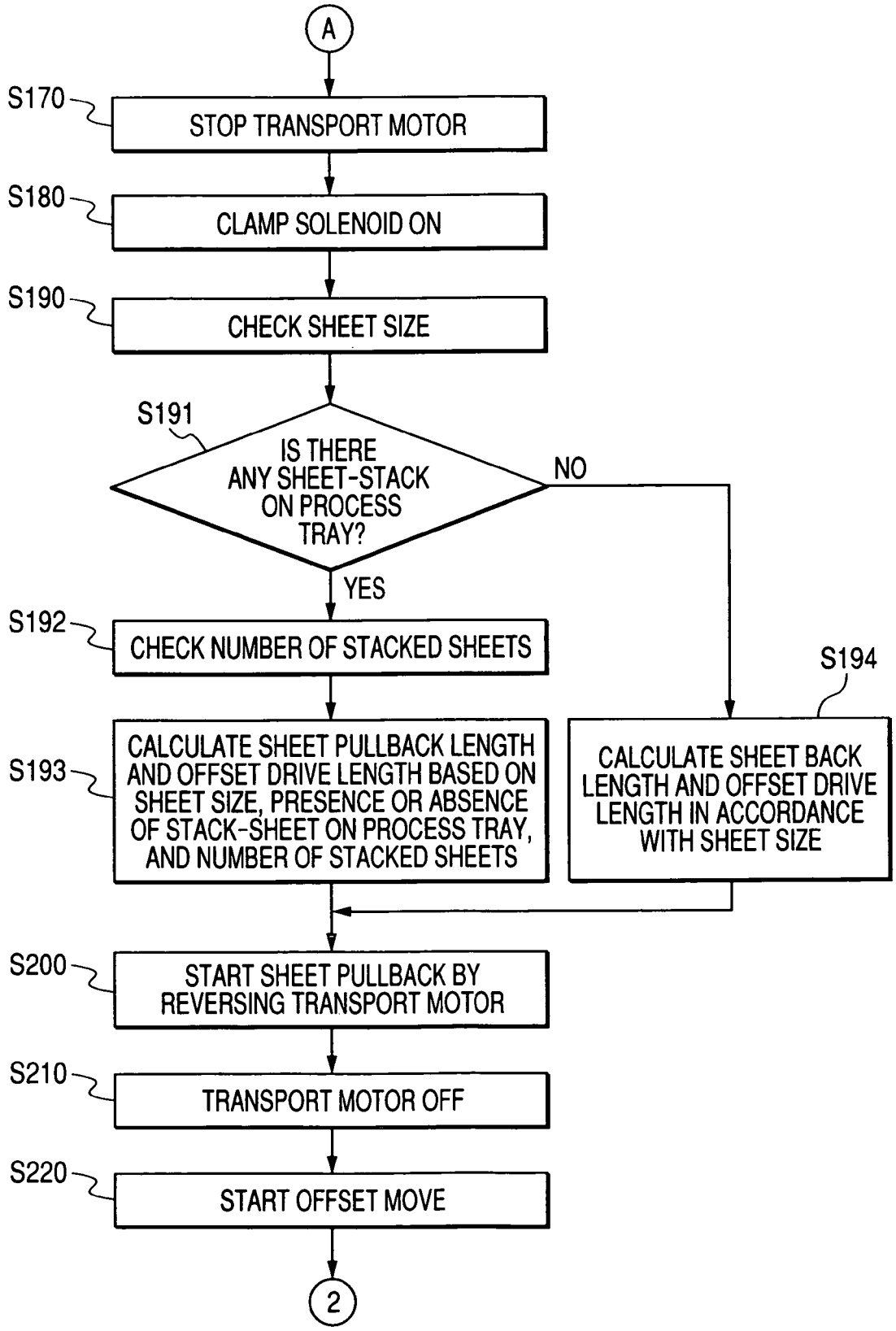

When the main body 500A of the apparatus initiates an image formation, CPU 100 discriminates, as shown in FIGS. 11A and 11B, whether a sheet delivery signal has been received from the controller 140 (FIGS. 1, 11A and 11B) of the main body 500A (S100). If received (YES in S100), the CPU 100 turns on the pickup solenoid 433 (S110) thereby pulling up the offset roller 407 and turns on the transport motor 431 (S120) thereby starting to rotate the transport roller 405 and the offset roller in the forward direction.

Then the front end of the sheet after image formation turns on the entrance sensor 403 (YES in S130), and is transferred to the transport roller 405, and, when the rear end of the sheet passes through the sheet delivery part 208 (FIG. 1) to turn off the entrance sensor 403 (FIG. 2) (YES in S140), the CPU 100 turns off the pickup solenoid 433 (S150), thereby dropping the offset roller 407.

Thus, as shown in FIG. 13A, the offset roller 407, rotating in the sheet transporting direction comes into contact with the sheet S under transporting, whereby the sheet S is once transported in the downstream direction, on the process tray 410 by the offset roller 407.

Thereafter, when the sheet S is transported to a predetermined position (YES in S160), the CPU 100 terminates the rotation of the transport motor 431 (S170) thereby stopping the sheet S at a position shown in FIG. 3. Subsequently the CPU 100 turns on the clamp solenoid 434 (S180), thereby opening, as shown in FIG. 13B, the sheet clamp member 412 positioned in the vicinity of the sheet rear end stopper 411.

Thereafter, the CPU 100 checks the size of the delivered sheet, based on the size information from the main body 500A (S190). It also discriminates, by the sheet stack delivery sensor 415, whether a stacked sheet is present on the process tray 410 (S191).

In the absence of stacked sheet (NO in S191), it calculates, as shown in FIG. 18A, a sheet pullback distance according to the size of the sheet S, namely a transport distance (effective radius of the offset roller 407×rotation angle) for the sheet in order to cause the rear end of the sheet, delivered on the process tray 410, to impinge on the sheet rear end stopper 411 (S194). Also as shown in FIGS. 17A to 17C, a travel distance Y is calculated according to the size of the delivered sheet, and a slip amount to be added to the travel distance Y is set according to the sheet size, whereby a travel distance as shown in FIG. 18B, which is a transport distance including the slip of the offset roller 407, is calculated.

In the present embodiment, the transport distance including the slippage at the sheet pullback is judged, as shown in FIG. 18A, according to whether the sheet length in the transport direction is 279 mm and above, or less, and is selected as 40 mm for a sheet length of 279 mm or larger and as 35 mm for a sheet length less than 279 mm, but the sheet length may be divided further and the transport distance may be varied for each divided size.

In case a stacked sheet is present (YES in S191), a number of stacked sheets is checked (S192). Then, according to the size of the delivered sheet S and the number of stacked sheets on the process tray 410, there is calculated, as shown in FIG. 18A, a sheet pullback distance, namely a transport distance in order to cause the rear end of the sheet to impinge on the sheet rear end stopper 411 (S193). Also as shown in FIGS. 17A to 17C, a travel distance Y is calculated according to the size of the delivered sheet, and a slip amount to be added to the travel distance Y is set according to the sheet size, whereby a travel distance as shown in FIG. 18B, which is a transport distance including the slip of the offset roller 407, is calculated.

In either case, the pullback distance is converted into a pulse number for rotation angle of the transport motor 431 and is set in the transport distance counter, and the travel distance of the offset roller 407 is converted into a pulse number for rotation angle of the offset motor 432 and is set in the travel amount counter.

After the setting of the transport distance counter, the transport motor 431 is activated in the reverse direction to rotate the offset roller 407 in the reverse direction and to execute a transport by the set count (S200). Thus, as shown in FIG. 13B, the sheet S is transported to the upstream side and impinges on the sheet rear end stopper 411, thereby being subjected to a rear end alignment. In this operation, the transport distance of the offset roller 407 including slippage is selected, in consideration of a skew in the sheet S, somewhat longer than a distance from the switchback point of the sheet S to the sheet rear end stopper 411.

More specifically, the offset roller 407, after the sheet S impinges on the sheet rear end stopper 411, rotates (slips) for a predetermined time to correct the skew, whereby the entire rear end of the sheet S contacts the sheet rear end stopper 411. The transport motor 431 stops after the transport by the preset distance (S210).

Then, as shown in FIG. 13C, the offset motor 432 is activated to drive, through the offset pinion 516 (FIG. 4) and the offset track 515, the offset roller 407 thereby causing an offset travel along the offset shaft 511. Thus the offset motor 432 rotates by pulses of a number set in the travel amount counter, and the offset roller 407 executes an offset travel by the anticipated transport distance (S220). At the travel of the offset roller 407, the sheet S in contact with the offset roller 407 moves with the offset roller 407 by the frictional force thereof, toward the width direction positioning wall 416. In this state, the sheet clamp member 412 remains open as shown in FIG. 15B, so as not to hinder the movement of the sheet S.

Then the offset roller 407, after the sheet S impinges on the width direction positioning wall 416 as shown in FIG. 13C, continues to slide on the sheet for a while and then stops. Subsequently the CPU 100, in order to rectify an alignment error at the sheet rear end, caused by the offset movement of the sheet, rotates the offset roller 407 again in the reverse direction, thereby pulling back the sheet (S230). In this manner that the first sheet S is re-aligned at the rear end, whereby the sheet alignment is completed.

Then, when the alignment of the first sheet S is thus completed, the CPU 100 turns on the pickup solenoid 433 (S240) to lift the offset roller 407 as shown in FIG. 14A, and then turns off the clamp solenoid 434 (S250). Thus, as shown in FIG. 14B, the sheet clamp 412 is closed, and the aligned sheet S is supported by the sheet clamp 412. As a result, the first delivered sheet S can be prevented from being entrained, in the downstream side in the sheet transport direction, by a subsequently delivered sheet.

Then, as shown in FIG. 14B, the offset roller 407 remaining in the lifted state is returned, by the offset motor 432 and through the offset pinion 516 (FIG. 4) and the offset track 515, to the home position (S260).

The CPU 100 then discriminates whether the sheet S contained on the process tray 410 is a last sheet corresponding to a last page of the originals to be copied (S270), and, in case it is identified as not the last sheet S according to the information transmitted from the main body 500A (NO in S270), returns to the process of S100 to receive a next sheet delivery signal transmitted from the main body 500A and repeats the flow of S100 to S270 until the last sheet S is stacked on the process tray 410.

In this manner, at every delivery of the sheet S from the main body 500A of the apparatus, the CPU 100 of the sheet processing apparatus 400 recognizes the size of the sheet S, also calculates the sheet pullback travel amount and the width direction travel amount suitable for such sheet S. The CPU 100 regulates the rotation amount and the offset travel amount of the offset roller 407 based on such travel amounts, thereby aligning the rear end of the sheet by impingement on the sheet rear end stopper 411 and also aligning the lateral end of the sheet by impingement on the width direction positioning wall 416.

When a last sheet is identified (YES in S270), a sheet stack corresponding to the originals to be copied should have been formed on the process tray 410, and the CPU 100 discriminates whether a stapling process is selected (S280), and, if selected (YES in S280), drives a stapler unit 420 to execute a stapling process shown in FIG. 16 (S290).

If the stapling process is not selected (NO in S280) or if the stapling process is completed, the CPU 100 advances, as shown in FIG. 6, the sheet stack delivery member 413 supporting the sheet stack SA by the sheet clamp 412 toward the stack trays 421, 422 by the sheet stack delivery motor 430 and causes the sheet stack SA to be delivered (S300).

Then, in synchronization with the delivery operation for the sheet stack SA, the CPU 100 executes a descending operation of the stack tray 421 (S310), and then returns the sheet stack delivery member 413 to the home position (S320). Thereafter, the CPU 100 stops the transport motor 431 for stopping the rotation of the transport roller 405 and the offset roller 407 (S330), and turns off the pickup solenoid 433 (S340) to lower the offset roller 407, whereby the sequence of processes is terminated.

<Effect of Sheet Processing Apparatus of Present Embodiment>

The sheet processing apparatus 400 of the present embodiment, which executes the rear end alignment and the lateral end alignment by sheet transport on the process tray 410 by the offset roller 407 only, can be realized by a simple constitution not requiring many members, in comparison with a sheet processing apparatus as described in Japanese Patent Application Laid-open No. H08-67400, requiring separate transport members for the rear end alignment and the lateral end alignment.

Also the process tray 410 is realized shorter by supporting the front end side of the sheet stack by the stack tray 421 (422) and positioning the center of gravity of the sheet outside the process tray 410. For this reason, the sheet processing apparatus 400 has a reduced entire length and can be realized compacter in comparison with the sheet processing apparatus as described in Patent Reference 1, having a process tray of a full A3 size, thus being incorporated also in a relatively compact copying apparatus 500.

Also the rotation amount of the offset roller 407, for causing the rear end of the sheet to impinge on the sheet rear end stopper 411, is selected for a transport somewhat longer than the distance from the switchback point of the sheet to the sheet rear end stopper 411. Stated differently, even after the sheet is transported by the reverse rotation of the offset roller 407 by the distance to impinge on the sheet rear end stopper 411, the offset roller 407 still continues the reverse rotation for a predetermined time, whereby the sheet can be securely contacted with the sheet rear end stopper 411.

Also the rotation amount of the offset roller 407, for causing the rear end of the sheet to impinge on the sheet rear end stopper 411, may be made variable according to the sheet size in consideration of the friction between the process tray 410 and the sheet, and also according to presence/absence of the sheet stacked on the process tray 410. It is thus rendered possible to alleviate alignment errors such as an incomplete returning of the sheet or a crease formation in the rear end part of the part resulting from an excessive returning, thereby reducing the aberration in the sheet alignment at the rear end alignment. Thus, a highly precise rear end alignment is made possible.

In the present embodiment, as shown in FIGS. 18A and 18B, the transport distance including the slippage is made different according to presence or absence of the stacked sheet. Instead, in case 10 or more sheets are stacked on the process tray 410, it is also possible to increase the travel distance by 2 mm for every 10 sheets, or, depending on the type of the sheets, to decrease the travel distance by 2 mm for every 10 sheets.

Also in the present embodiment, the pullback distance and the offset travel distance are controlled by setting the rotation angles of the transport motor 431 and the offset motor 432 in the transport distance counter and the travel amount counter virtually formed in the CPU 100. Instead, the pullback transport distance including the slippage may be controlling by providing a pulse encoder for detecting the rotation angle of the offset roller 407 and by counting output pulses thereof. Also the transport distance including slippage for the offset travel may be controlled by providing a linear encoder along the offset axis 511 and counting output pulses thereof.

Also the pullback distance and the offset travel distance of the offset roller 407 may be controlled by rotating the transport motor 431 and the offset motor 432 at constant speeds, by setting, in a pullback timer and an offset travel timer virtually formed in the CPU 100, operation times corresponding respective transport distances including slippages, and by activating the transport motor 431 and the offset motor 432 for respectively set times.

Also in the stapling mode, the offset roller 407 moves the sheet in the width direction for impingement on the positioning wall 416. Instead, in case the stapling mode is not adopted (in case the sheets are not stapled), the sheets may be directly delivered without being sorted.

Also the stapler unit 420 is fixedly provided in the vicinity of the width direction positioning wall 416, but such constitution is not restrictive and it may be made movable in the sheet transporting direction or in the width direction. Such movable stapler unit 420 can be used for executing a stapling process of stapling another position or plural positions of the sheet stack SA in the sheet transporting direction or in the width direction.

The sheet processing apparatus of the present employs the offset roller 407 for aligning the rear end and the lateral end of the sheet. Similar effects can also be obtained by employing, instead of the roller member, transport direction travel means which moves in the sheet transport direction to move the sheet and perpendicular direction travel means which moves in a direction (width direction) perpendicular to the sheet transport direction to move the sheet in such width direction.

Also in the present embodiment, a program corresponding to the control sequence of the flow charts shown in FIGS. 11A, 11B and 12 is stored in the ROM 110, and the CPU 110 executes the control by reading such program. Instead, similar effects can be obtained by executing the processes on the control program by hardware.

Also in the present embodiment, the elevation control of the stack trays 421, 422 and the stapling control are executed by the CPU 100 of the sheet processing apparatus 400, but the present invention is not limited to such embodiment and such controls may be executed by the controller 140 provided in the main body 500A of the apparatus.

Another Embodiment

In the following, a sheet processing apparatus constituting another embodiment of the present invention, and an image forming apparatus equipped with such sheet processing apparatus will be explained with reference to FIGS. 19 to 31. The image forming apparatus may be a copying apparatus, a facsimile apparatus, a printer or a composite apparatus thereof. Therefore, the sheet processing apparatus of the present invention is not necessarily connected to the main body of the copying apparatus. Also the sheet processing apparatus may be incorporated in a main body of the image forming apparatus. The sheet processing apparatus of the present embodiment is equipped with a stapler for stapling a sheet stack, but may instead be equipped with a punching apparatus for forming a punched hole in the sheet stack.

<Image Forming Apparatus>

Figure 19:
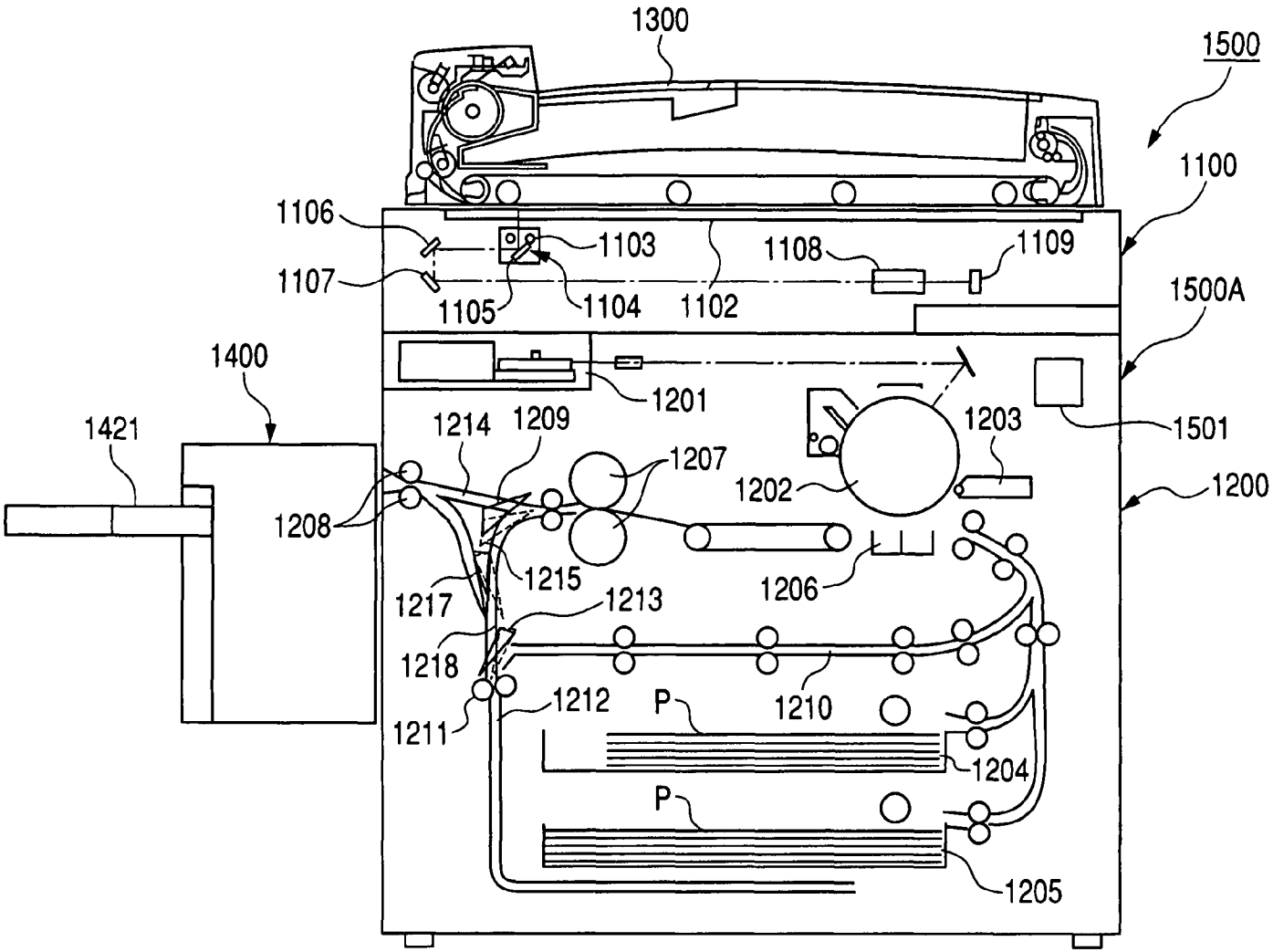
FIG. 19 is an elevation view of a copying apparatus equipped with a sheet processing apparatus constituting another embodiment of the present invention.

FIG. 19 is an elevation view of an image forming apparatus equipped with a sheet processing apparatus constituting another embodiment of the present invention. The image forming apparatus of the another embodiment, for example a copying apparatus 1500, is provided with a printer unit 1200 constituting image forming means, and a sheet processing apparatus 1400 constituting sheet processing means.

The copying apparatus 1500 incorporates a reader portion 1100, a printer portion 1200, and a sheet processing apparatus 1400. On an upper part of the copying apparatus 1500, an automatic document feeder (hereinafter called "ADF") 1300 for feeding documents one by one onto a platen glass 1102 is mounted. On a lateral side of the main body 1500A of the copying apparatus 1500, the sheet processing apparatus 1400 is connected for executing a post process on a sheet delivered from the main body 1500A of the copying apparatus 1500.

As shown in FIG. 19, the reader portion 1100 reads an original image and converts it into image data. The printer portion 1200 is equipped with plural sheet cassettes 1204, 1205 each stacking plural sheets, and, in response to a print command, forms a visible image of the image data on a sheet P.

In the reader portion 1100, the ADF conveys the original through a predetermined position on the platen glass 1102 and the original is illuminated by the light of a lamp 1103 of a scanner unit 1104 stopped in such predetermined position. Otherwise, an original placed on the platen glass 1102 by the user by opening the ADF 1300, and the original is illuminated by the light of the lamp 1103 of the scanner unit 1104 which is moved in the lateral direction.

A light reflected from the original is introduced, through mirrors 1105, 1106, 1107 and a lens 1108, into a CCD image sensor 1109, and is subjected therein to an electrical process such as a photoelectric conversion and ordinary digital processes. Thereafter, an obtained electrical signal is supplied to the printer portion 1200.

The image signal supplied to the printer portion 1200 is converted in an exposure control portion 1201 into a modulated optical signal for irradiating a photosensitive member 1202. A latent image formed by the irradiating light on the photosensitive member 1202 is subjected to a toner development by a developing device 1203 thereby forming a toner image. Then, in synchronization with the front end of the toner image, a sheet P is conveyed from either of the sheet cassettes 1204, 1205 and the toner image is transferred in a transfer part 1206 onto the sheet P. The transferred toner image is fixed in a fixing portion 1207 onto the sheet P. The sheet P bearing the fixed toner image passes through a path 1214 and is discharged from a sheet delivery portion 1208 to the exterior of the main body 1500A of the copying apparatus 1500. Thereafter, the sheet is subjected to a sorting or a stapling in the sheet processing apparatus 1400 according to an operation mode designated in advance.

In case of image formations on both sides of a sheet, the sheet P bearing, on one side thereof, a toner image fixed in the fixing portion 1207, is guided by switching members 1209, 1217, maintained in solid-lined positions, to paths 1215, 1218 and further guided by a switching member 1213 maintained in a broken-lined position, to a reversing path 1212. After the rear end of the sheet P passes the switching member 1213, it is switched to a solid-line position and rotation of a roller 1211 is reversed, whereby the sheet P is reversed in the transporting direction and transported to a transfer sheet stacking portion 1210. Then the sheet P is supplied toward the photosensitive member 1202. When a next original is prepared on the platen glass 1102, the image of the original is read in a similar manner as in the above-described process. As the sheet P is supplied from the transfer sheet stacking portion 1210, two images are formed respectively on the front and rear surfaces of a same sheet.

<Sheet Processing Apparatus>

Figure 20:
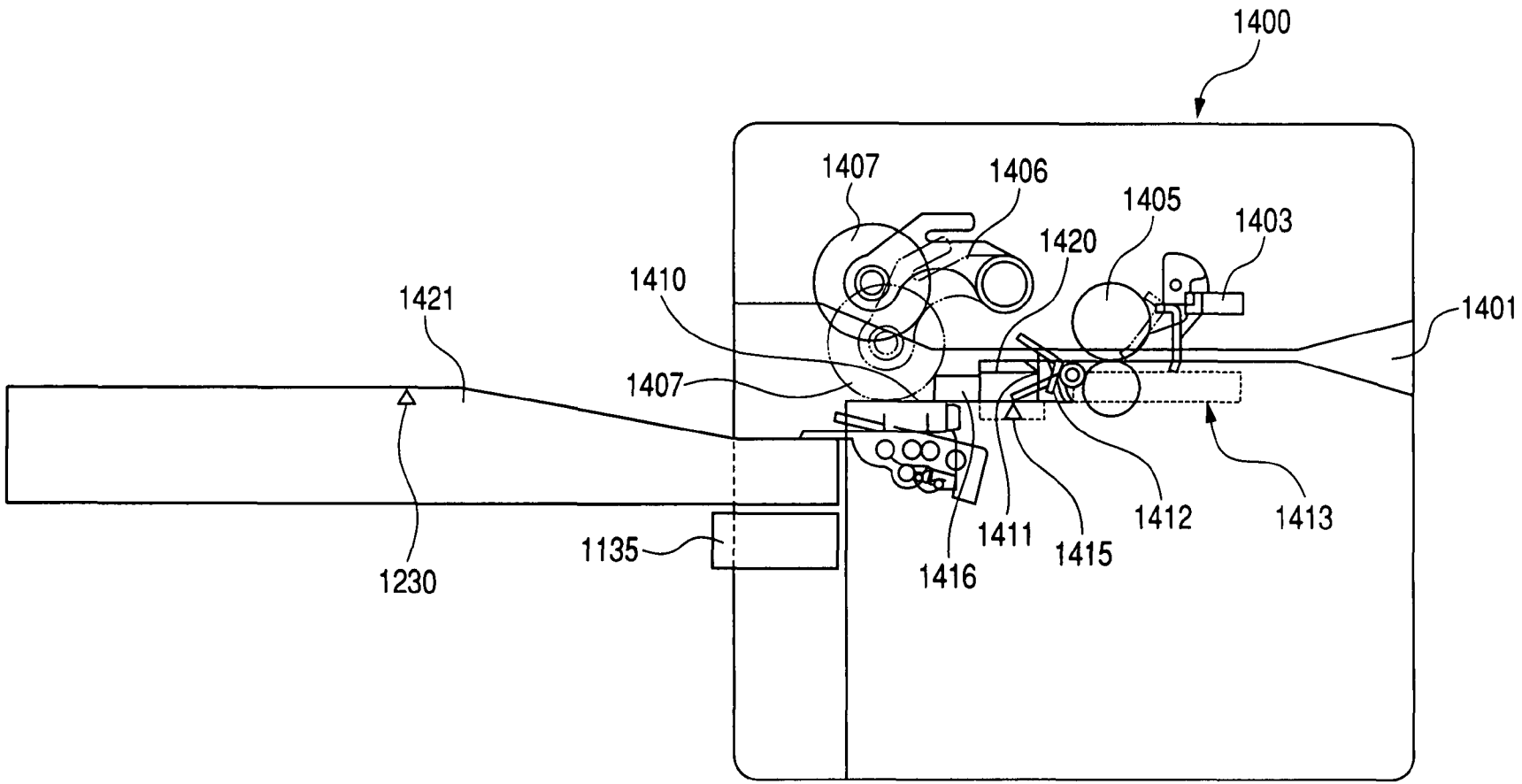
FIG. 20 is a frontal cross-sectional view of the sheet processing apparatus in the other embodiment.
Figure 21A:
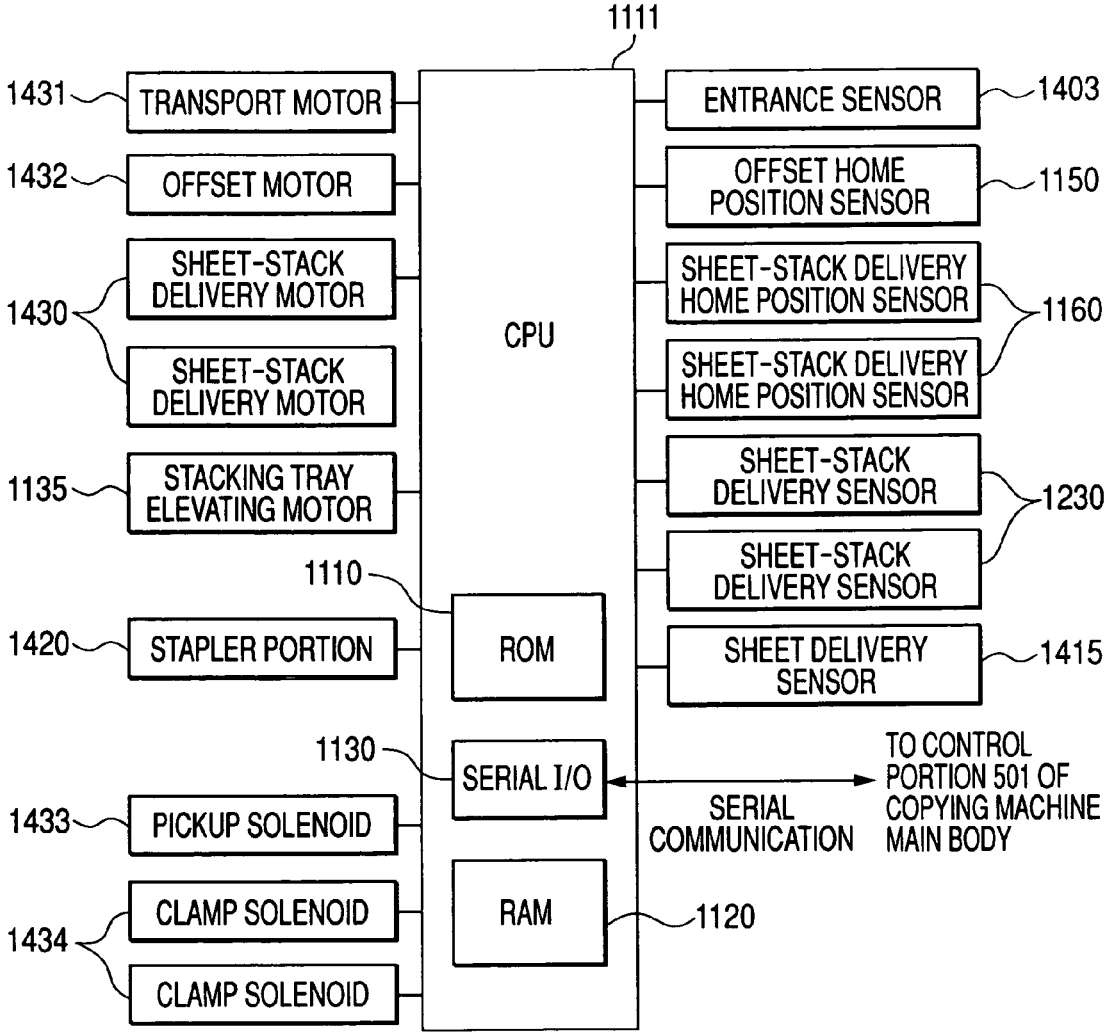
FIGS. 21A and 21B are block diagrams of a controller of the sheet processing apparatus of the other embodiment.
Figure 21B:
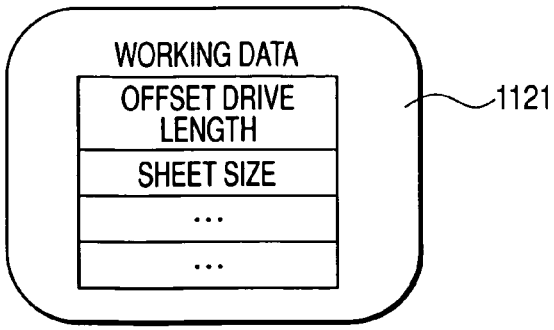
Figure 22:
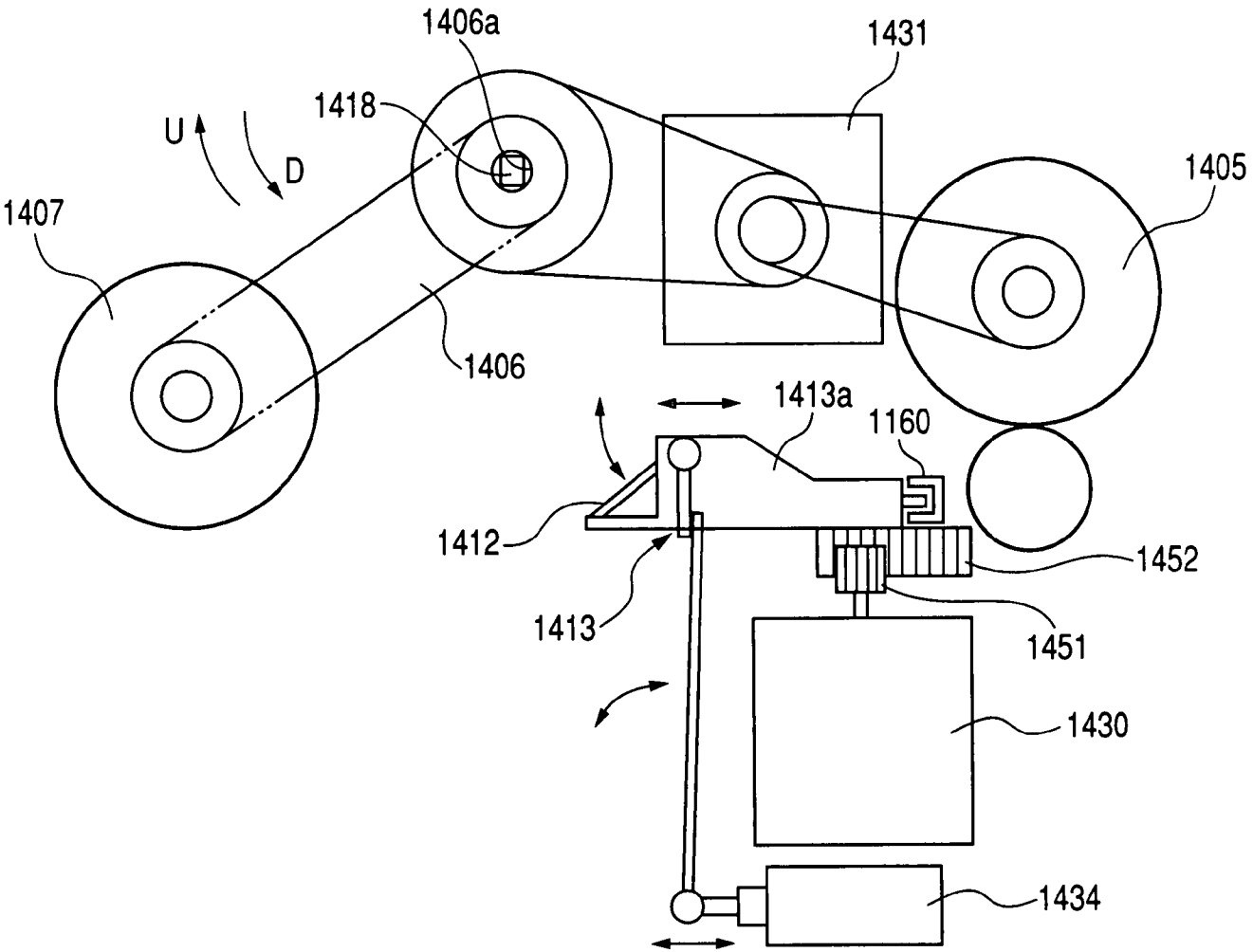
FIG. 22 is a schematic view showing a drive mechanism for an offset roller and a clamp mechanism.
Figure 23:
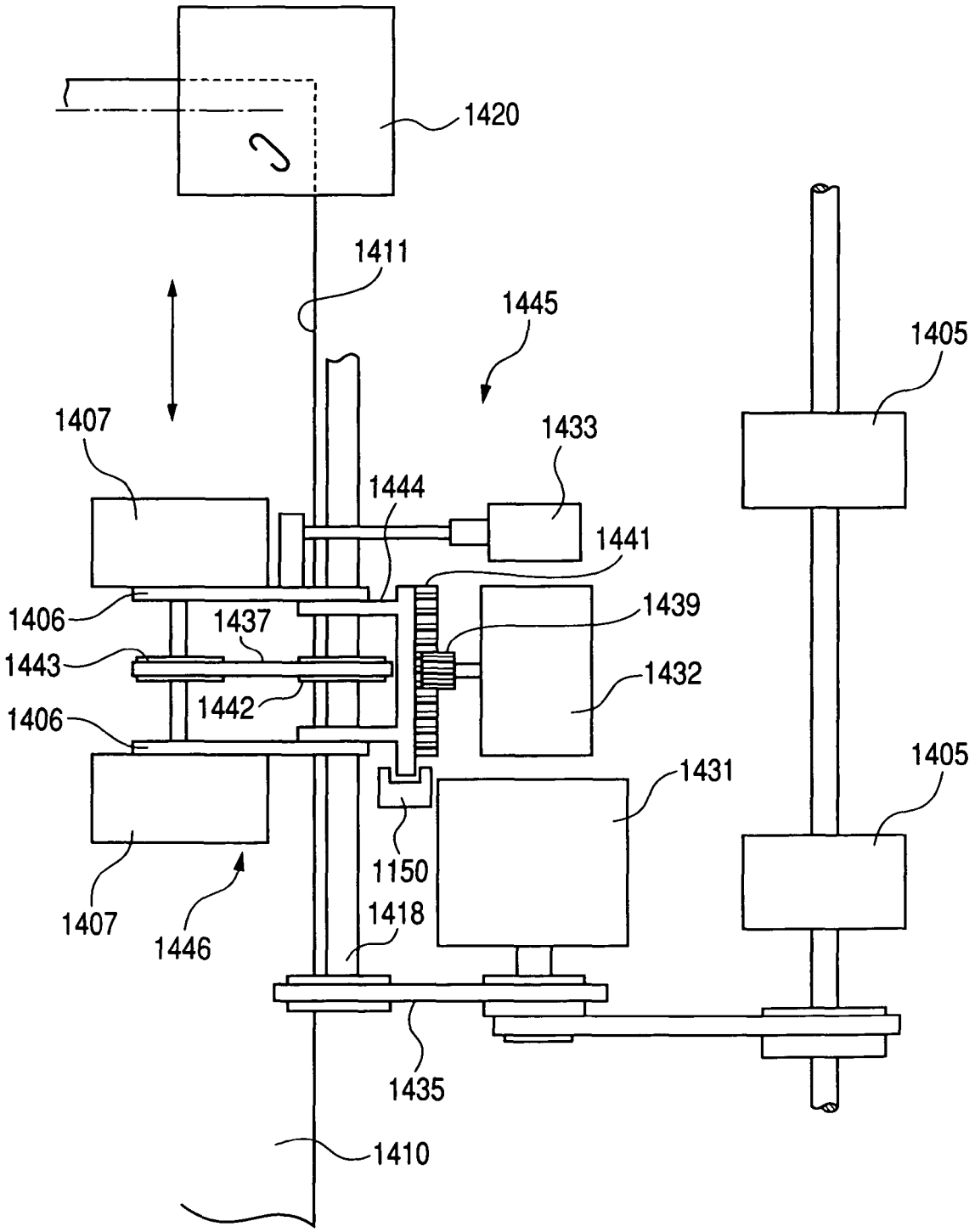
FIG. 23 is a schematic view showing a drive mechanism for an offset travel of the offset roller.
Figure 24:
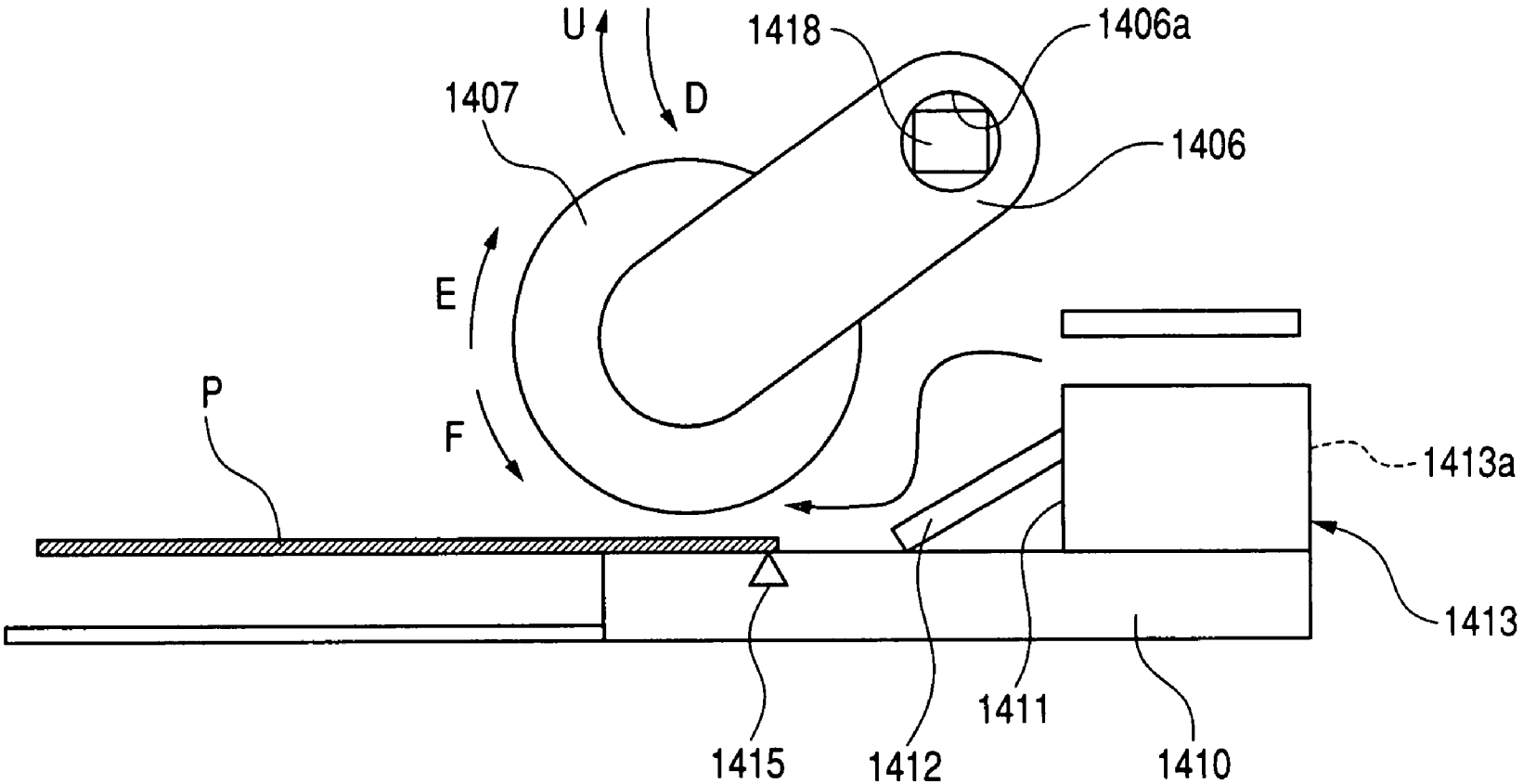
FIG. 24 is a schematic view showing a control on the rotating direction of the offset roller.
Figure 25:
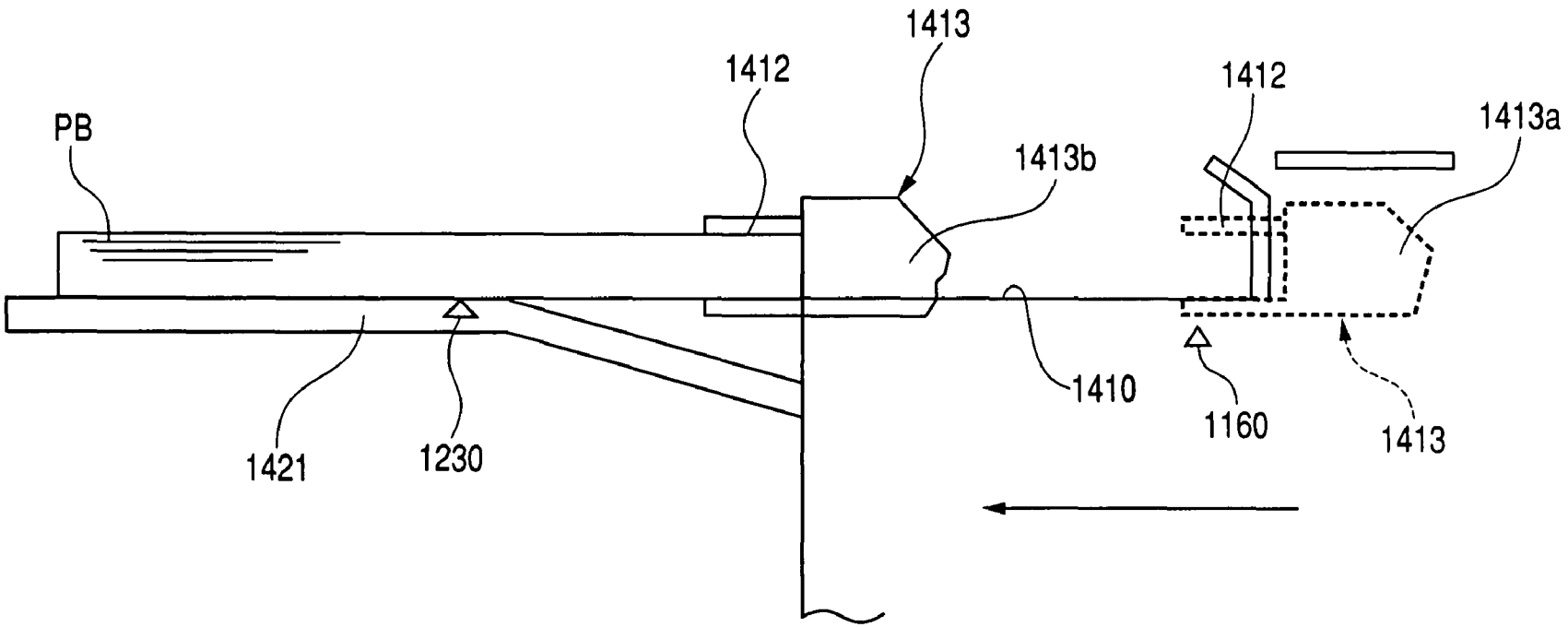
FIG. 25 is a schematic view showing a sheet stack delivery by a sheet stack delivery member.

FIG. 20 is a frontal cross-sectional view of the sheet processing apparatus 1400 in the other embodiment; FIGS. 21A and 21B are block diagrams of a control system of the sheet processing apparatus in the other embodiment; FIG. 22 is a schematic view showing a drive mechanism for an offset roller and a clamp mechanism; FIG. 23 is a schematic view showing a drive mechanism for an offset travel of the offset roller; FIG. 24 is a schematic view showing a control on the rotating direction of the offset roller; and FIG. 25 is a schematic view showing a sheet stack delivery by a sheet stack delivery member.

The sheet processing apparatus 1400 of the present embodiment is provided with a process tray 1410 as a processing stack member, a transport roller 1405 as a delivery member, a sheet rear end stopper 1411 as a rear end impingement member, a width direction positioning wall 1416 as a lateral end impingement member, an offset roller 1407 as transport means, a CPU 1111 as control means, an offset roller 1407 as a roller member, a clamp mechanism 1413 as sheet stack delivery means, and a sheet clamp member 1412 as sheet clamping means.

As shown in FIG. 20, the sheet processing apparatus 1400 temporarily stacks, on the process tray 1410, sheets delivered in succession from the main body 1500A (FIG. 19) of the apparatus, then transports the sheet by the offset roller 1407 on the process tray 1410 to form a sheet stack, and delivers the sheet stack, formed on the process tray 1410, onto the stack tray 1421 for final stacking. A stapler unit 1420 is used for stapling a stack of sheets, formed on the process tray 1410, of a number corresponding to that of the originals, but is not essential.

A stack tray 1421 is provided with a stack tray elevating motor 135 for upward or downward drive and can move and stop at an arbitrary height along the sheet processing apparatus 1400. The stack tray 1421, when a sheet stack is positioned thereon, is lowered by the thickness of such sheet stack, in order not to hinder the delivery of next sheet stack. Also the process tray 1410 is constructed shorter, and the sheet stack on the process tray 1410 is principally supported by the uppermost surface of a sheet stack PB on the stack tray 1421. Stated differently, the sheet stack PB on the stack tray 1421 constitutes a part of the process tray 1410, so that, when a sheet stack is discharged from the process tray 1410, the stack tray elevating motor 1135 lowers the stack tray 1421 to such a position that the uppermost surface of the sheet stack PB on the stack tray 1421 substantially matches the process tray 1410.

Referring to FIG. 21A, a CPU 1111 constituted of a microcomputer system controls the sheet processing apparatus 1400, based on a control signal from a controller 1501 (FIG. 19) in the main body 1500A of the apparatus. The controller 1501 in the main body 1500A, similarly constituted of a microcomputer system, and the CPU 1111 may be integrated in either.

Figures 26, 26A:
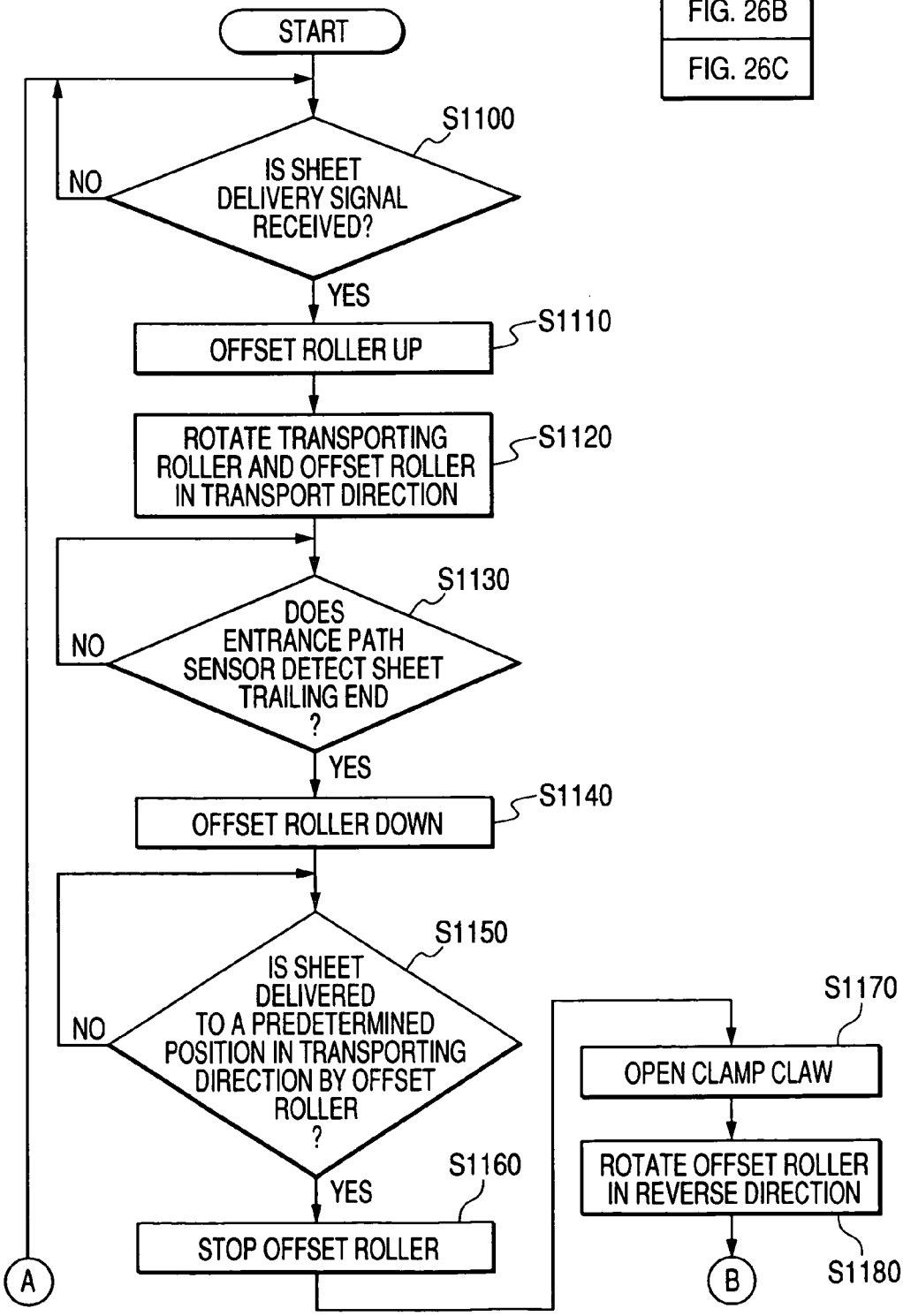
FIG. 26 which is composed of FIGS. 26A, 26B and 26C are flow charts of a sheet stack formation control in the sheet processing apparatus of this embodiment.
Figure 26B:
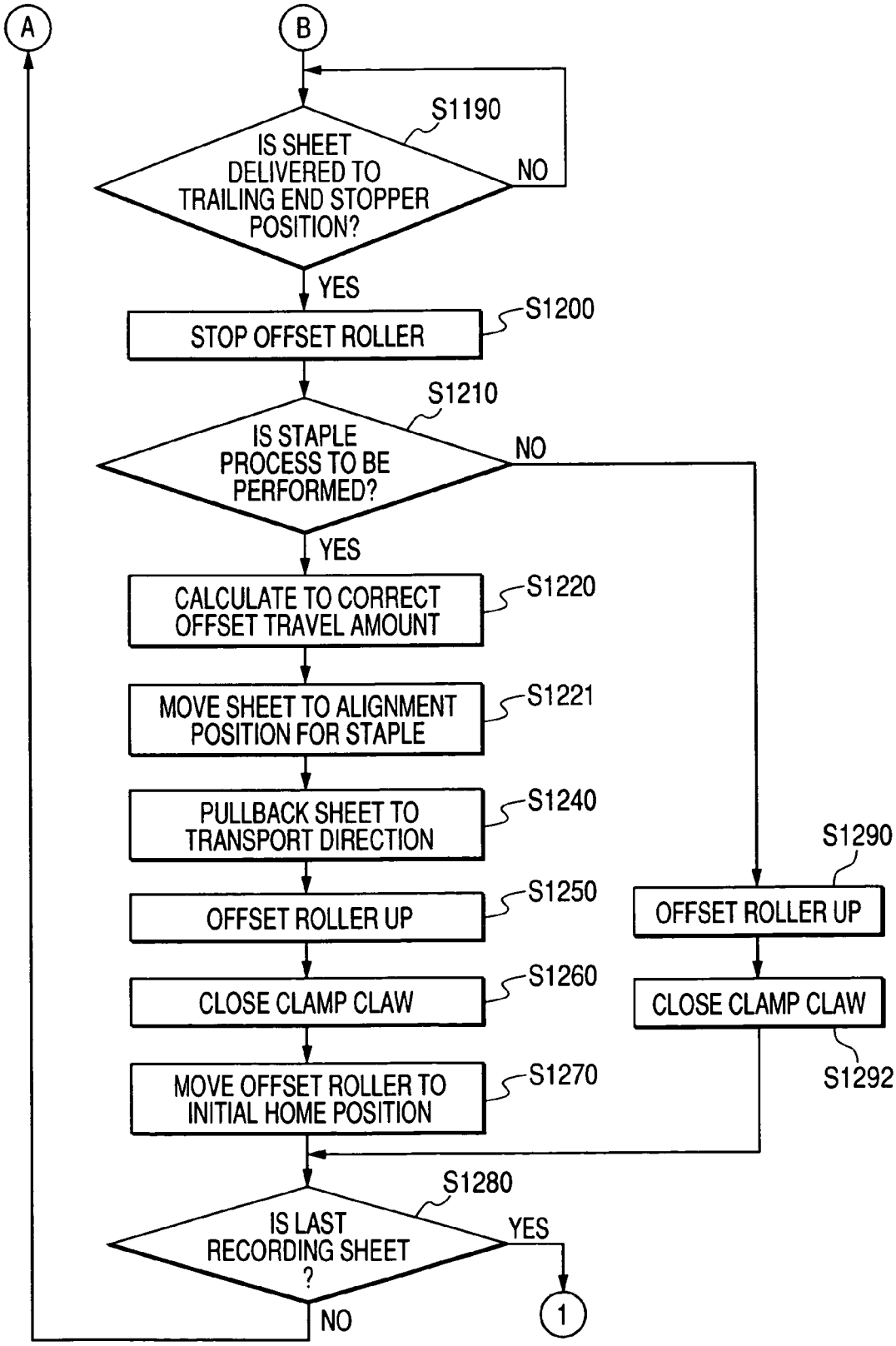
Figure 26C:
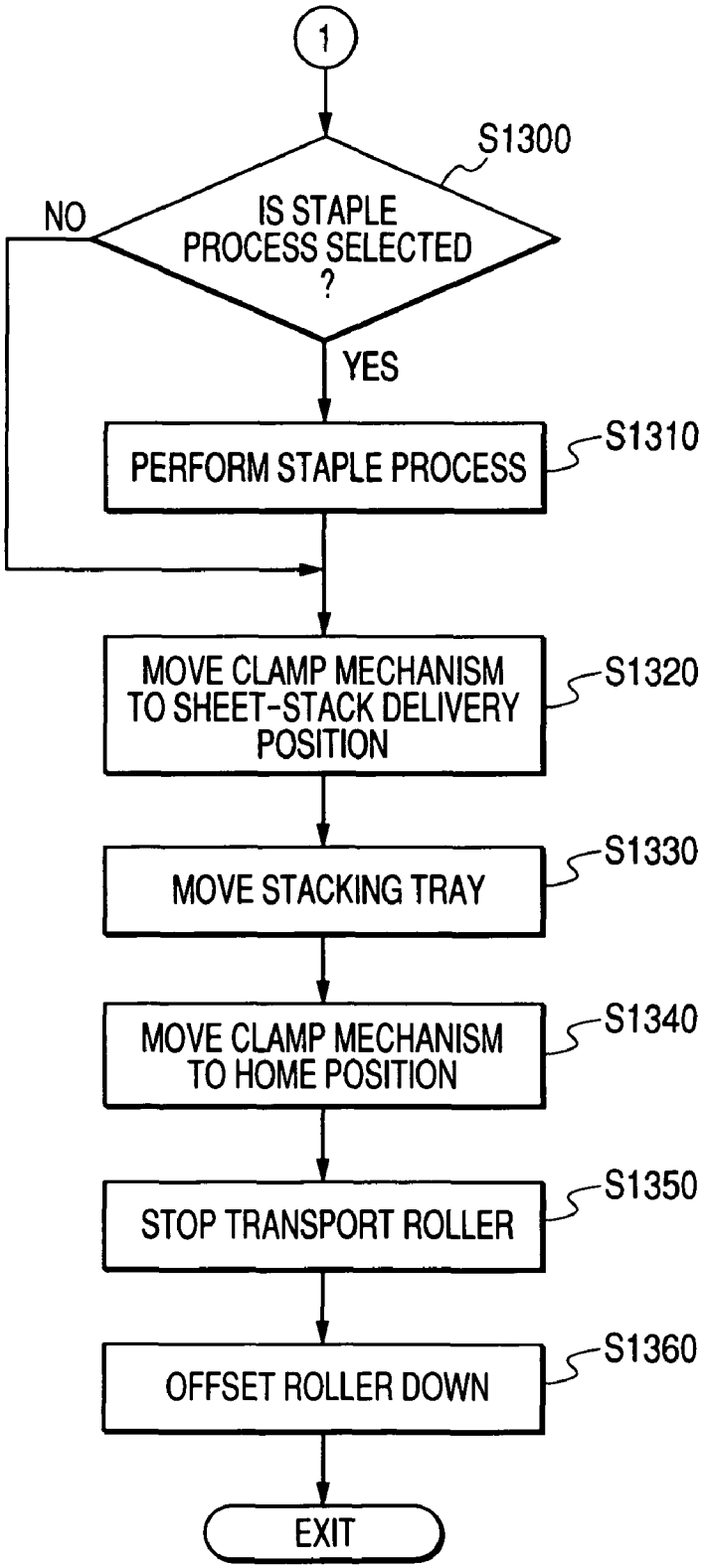

The CPU 1111 is equipped with a ROM 1110, which stores a program corresponding to a control sequence described in flow charts in FIGS. 26A to 26C. The CPU 1111 reads and executes the program stored in the ROM 1110, thereby controlling various parts.

The CPU 1111 is also equipped with a RAM 1120, which stores work data shown in FIG. 21B, and the CPU 1111 controls various parts based on such work data.

The CPU 1111 is further equipped with a serial interface 1130, and utilizes such serial interface 1130 for exchanging control data and control signals with the controller 1501 of the main body 1500A, for controlling various parts.

The CPU 1111 is connected, at input ports thereof, with sensors such as an entrance sensor 1403 for detecting a sheet delivered from the main body 1500A to a sheet receiving portion 1401 (FIG. 20), an offset home position sensor 1150 for detecting whether the offset roller 1407 (FIG. 23) is in an offset home position, a stack delivery home position sensor 1160 for detecting whether the clamp mechanism 1413 (FIG. 25) is in a home position 1413*a*, a sheet stack delivery sensor 1230 for detecting whether a sheet stack is delivered to the stack tray 1421 (FIG. 20), and a sheet delivery sensor 1415 for detecting whether a sheet is delivered to and stacked on the process tray 1410 (FIG. 24).

The CPU 1111 is also connected, at output ports thereof, to motors such as a transport motor 1431 for rotating the offset roller 1407 (FIG. 23) for transporting the sheet at first to the downstream side and then to the upstream side, an offset motor 1432 for moving the offset roller 1407 (FIG. 23) in the axial direction thereby moving the sheet in the lateral direction, a sheet stack delivery motor 1430 for reciprocating the clamp mechanism 1413 (FIG. 22) from the home position 1413*a* to a sheet stack delivery position (FIG. 25) thereby delivering the sheet stack to the stack tray 1421, and a stack tray elevating motor 1135 for elevating or lowering the stack tray 1421 (FIG. 20), and also to solenoids such as a pickup solenoid 1433 for lifting and lowering the offset roller 1407 (FIG. 23), and a clamp solenoid 1434 for opening and closing a clamp claw 1412 (FIG. 22).

The CPU 1111 executes the program stored in the ROM 1110 based on detection signals of these sensors, thereby controlling the motors and solenoids connected to the output ports and also the stapler unit 1420.

The clamp mechanism 1413 is provided in two units along the width direction of the sheet, and each of the stack delivery home position sensor 1160, the sheet stack delivery motor 1430, the clamp solenoid 1434 and the sheet stack delivery sensor 1230 is provided in two units respectively corresponding to the clamp mechanisms 1413, but both mechanisms, being same in structure and control, are represented by same numbers and the following description will be made on either clamp mechanism 1413 only.

As shown in FIGS. 22 and 23, a transport motor 1431, belts 1435, 1437, a square shaft 1418, pulleys 1442, 1443, an offset roller arm 1406 and an offset roller 1407 constitutes a transport direction shifting apparatus 1446, for selectively moving the sheet to the downstream side or the upstream side in the sheet transport direction.

As shown in FIG. 22, the offset roller 1407 is supported by the offset roller arm 1406 that can be lifted or lowered by a rotation in a directions U or D, and is lifted for accepting the sheet onto the process tray 1410 or lowered for transporting the sheet on the process tray. The offset roller arm 1406 has a circular hole 1406*a* and is rotatably supported by a square shaft 1418 of a square cross section. The offset roller arm 1406 is driven, as shown in FIG. 23, by the pickup solenoid 1433 provided movably along the square shaft 1418, and rotates in a direction U or D as shown in FIG. 22 to lift or lower the offset roller 1407.

The transport motor 1431, as shown in FIG. 23, is provided at an end of the square shaft 1418 and rotates the transport roller 1405 and the offset roller 1407 in the sheet transport direction or in the reverse direction, by an amount corresponding to the rotation amount thereof. Rotation of the transport motor 1431 is transmitted, through belts 1432, 1433, 1435, a square shaft 1418 and a pulley 1442, to the transport roller 1505 and the offset roller 1407.

Figure 27:
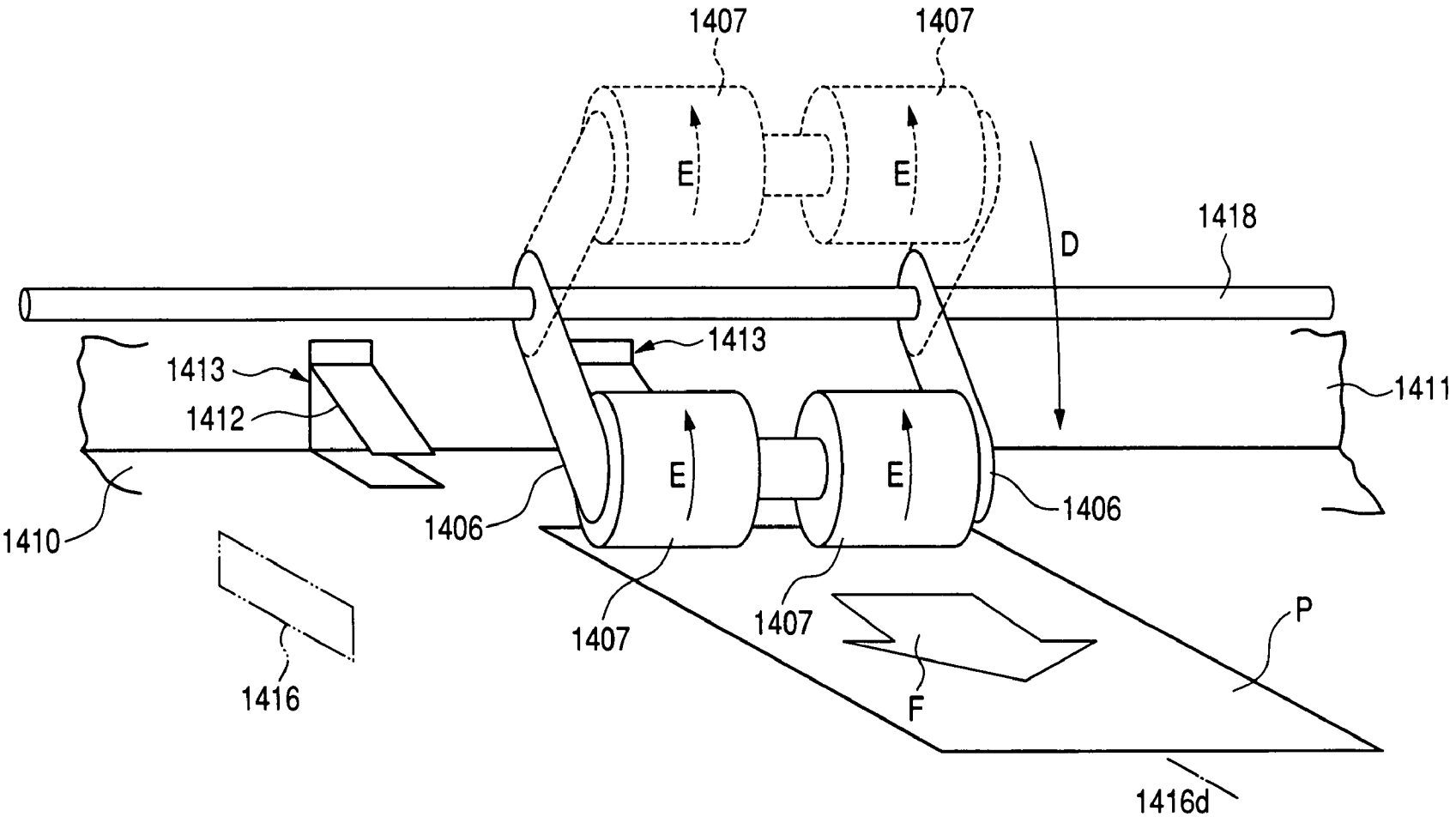
FIG. 27 is a schematic view showing a state of sheet stacking on the process tray.

An offset motor 1432, a pinion 1439, a rack 1441, a rack support member 1444, a square shaft 1418, an offset roller arm 1406 and an offset roller 1407 constitute a cross direction shifting apparatus 1445 for moving the sheet in the width direction. The cross direction shifting apparatus 1445 moves the offset roller arm 1406 *s* as to move the sheet from an offset home position 1416*d* (FIG. 27) to a position impinging on the lateral end alignment plate 1416 (FIG. 27).

When the offset motor 1432 is rotated, the offset roller 1407 moves toward the stapler 1420 by the pinion 1439 and the rack 1441. In such movement of the offset roller 1407 toward the stapler 1420, the offset roller 1407 entrains the sheet, by a contact friction thereon, on the process tray 1410 to the lateral end alignment plate 1416 (FIG. 27).

The pulley 1442 is mounted by fitting a central square hole on the square shaft 1418, and, by the engagement between the square hole and the square shaft 1418, integrally rotates therewith but is rendered movable, together with the offset roller arm 1406 and the like, along the square shaft 1418 in the thrust direction thereof.

Between a pair of the offset roller arms 1406, a rack support member 1444 having a square-C shape in a planar view and bearing a rack 1441 is provided and supported by the square shaft 1418. The rack support member 1444 is rotatably supported on the square shaft 1418, by means of a circular hole as in the offset roller arm 1406. The rack support member 1444 moves together with the offset roller arm 1406 along the square shaft 1418, but does not follow the rotation of the square shaft 1418. The rack 1441 meshes with a pinion 1439 provided on the stationary offset motor 1432.

Therefore, the belt 1437, the pulley 1443, the offset roller arm 1406 and the offset roller 1407 can be rotated upward or downward in a direction U or D about the square shaft 1418 as shown in FIG. 22, and can move in the width direction of the sheet together with the movement of the rack support member 1444, thereby approaching to or being separated from the stapler unit 1420.

When the front end of the sheet is transported to the process tray 1401 and the rear end of the sheet is detected by the entrance sensor 1403 (FIG. 20), the pickup solenoid 1433 (FIG. 23) is turned off whereby the offset roller 1407 as shown in FIG. 24 descends by the weight thereof and presses the upper surface of the sheet while rotating in the transport direction, thereby transporting the sheet to the downstream side and placing the entire sheet on the process tray 1410. The offset roller 1407 then stops and rotates in the reverse direction thereby aligning the sheet by a rear end impingement on the rear end stopper 1411. After the rear end alignment, the offset roller 1407 moves the sheet in the width direction, utilizing the friction with the sheet, thereby executing a lateral end alignment by an impingement on the lateral end alignment plate 1416 (FIG. 27). After the lateral end alignment, the offset roller 1407 returns, by the reverse rotation of the offset motor 1432, to and stops at the offset home position whereby the offset home position sensor 1150 (FIG. 23) is turned on. In returning to the offset home position, the offset roller 1407 is separated from the sheet and does not, therefore, perturb the lateral end alignment of the sheet.

The clamp mechanism 1413 provided in the vicinity of the rear end stopper 1411 approaches to or is separated from the stack tray 1421 as shown in FIG. 25, when, as shown in FIG. 22, the stationary sheet stack delivery motor 1430 is rotated to drive a rack 1452 mounted on the clamp mechanism 1413 by a pinion 1451.

A clamp claw 1412 of the clamp mechanism 1413 is opened or closed as shown in FIG. 22, by the clamp solenoid 1434 integrally moving with the clamp mechanism 1413. The clamp claw 1412 supports, by pinching the rear end, the sheet aligned by the offset roller 1407 on the process tray 1410, whereby such sheet is not entrained when a next delivered sheet is transported by the offset roller 1407.

As shown in FIG. 25, the clamp mechanism 1413, supporting the sheet stack PB formed on the process tray 1410 by the clamp claw 1412, pushes such sheet stack from the home position 1413*a* toward the stack tray 1421. Subsequently, upon reaching a stack delivery position 1413*b*, the clamp mechanism 1413 releases the clamp claw 1412 to deliver the stack from the process tray 1410 to the stack tray 1421. The clamp mechanism 1413 in the home position 1413*a* is detected by the stack delivery home position sensor 1160. Also whether a sheet stack has been delivered to the stack tray 1421 is detected by the sheet stack delivery sensor 1230 provided on the stack tray 1421.

<Control of Sheet Processing Apparatus>

Figure 28:
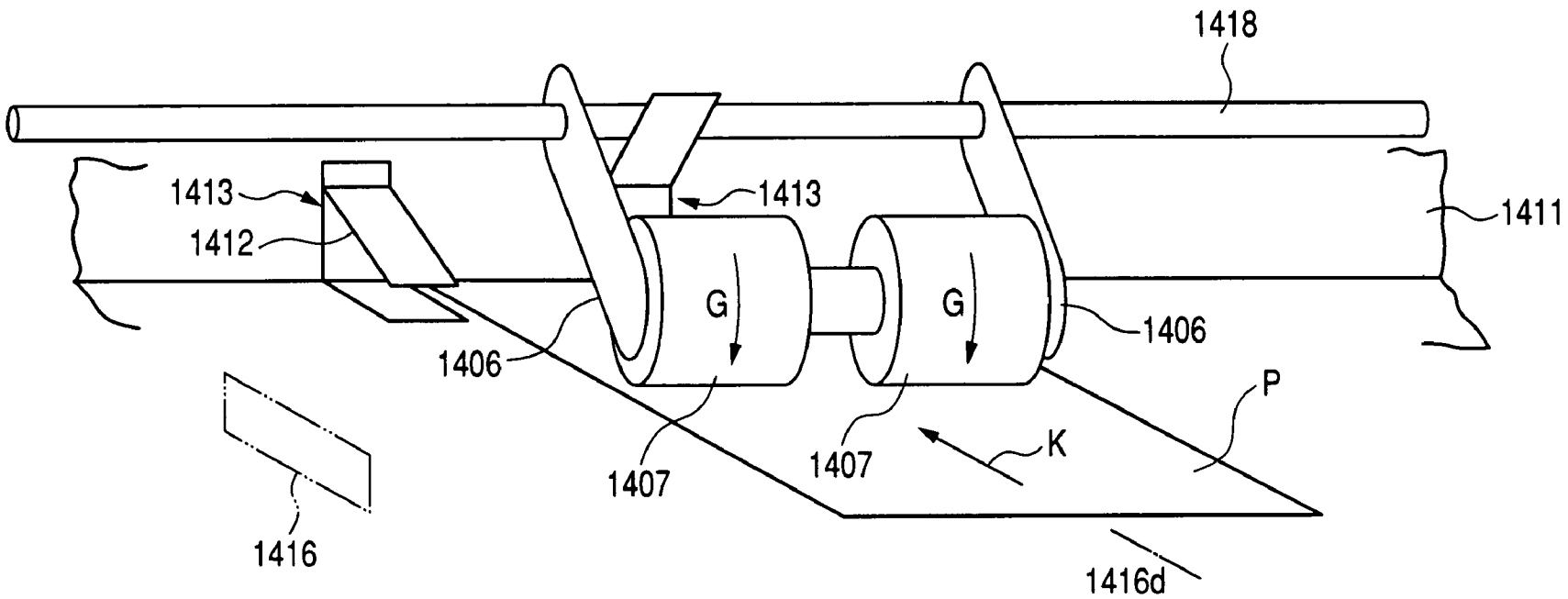
FIG. 28 is a schematic view showing a state of a sheet rear end alignment.
Figure 29:
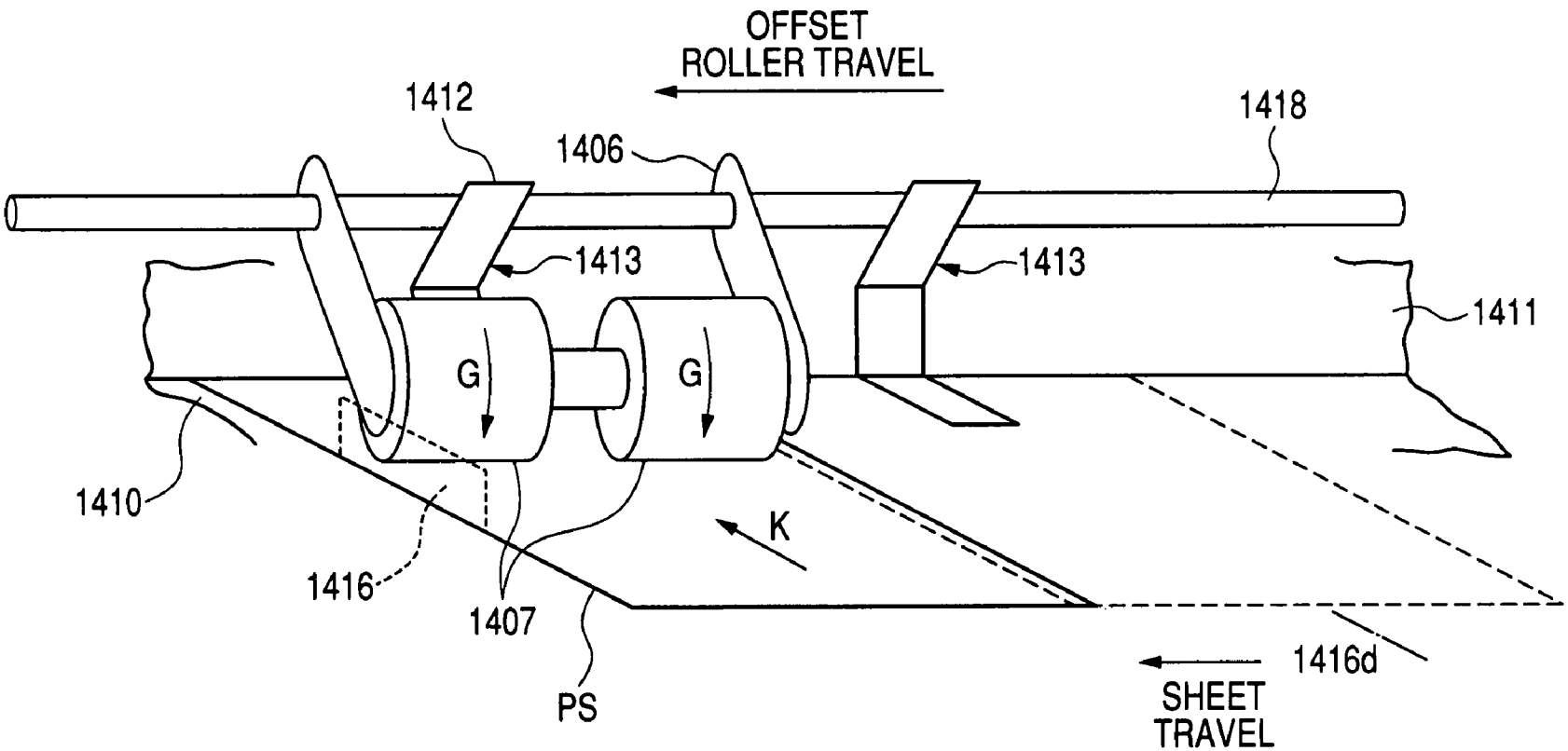
FIG. 29 is a schematic view showing a state of a sheet lateral end alignment.
Figure 30:
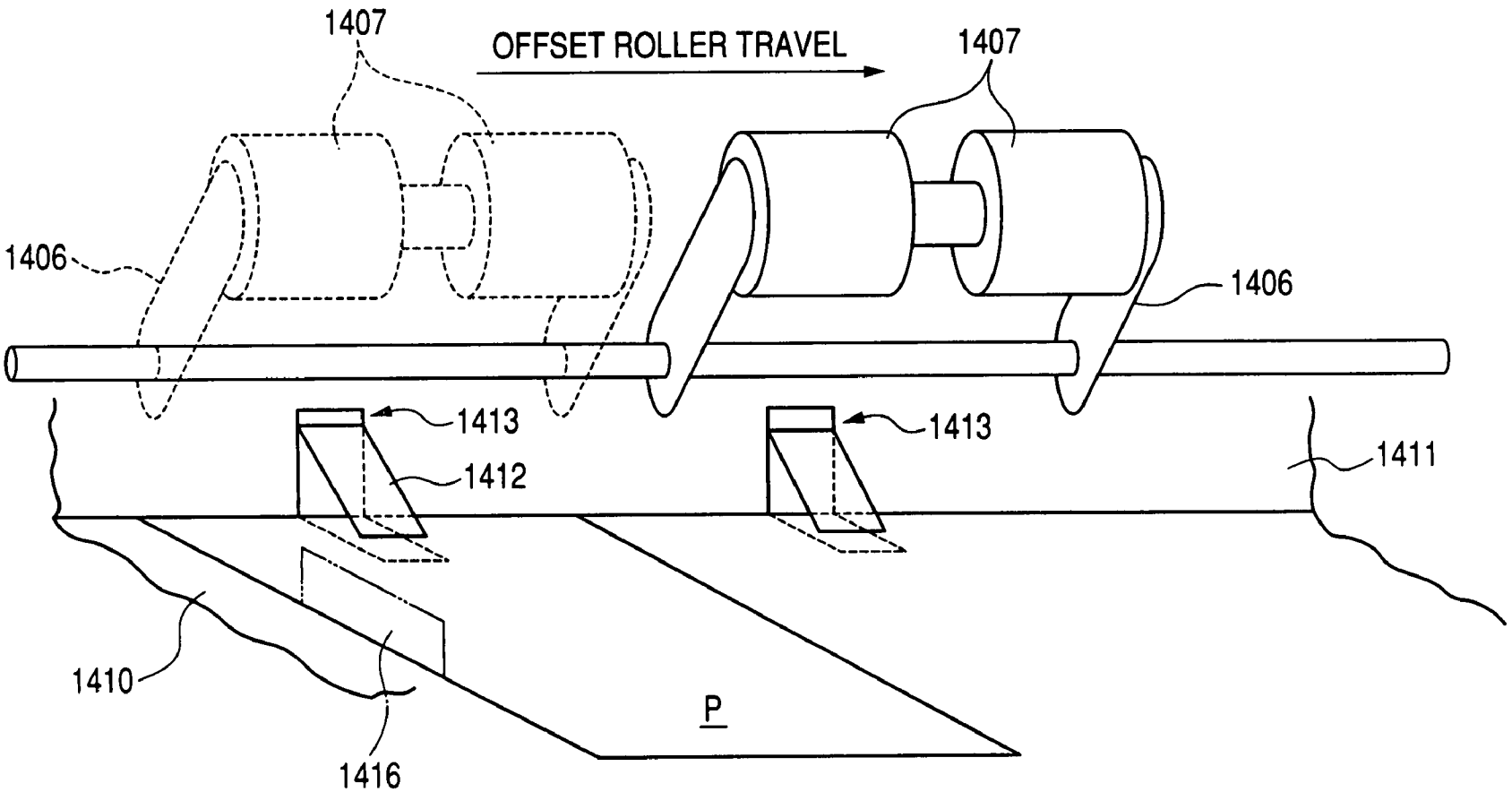
FIG. 30 is a schematic view showing a state of returning the offset roller to a home position.

FIGS. 26A to 26C are flow charts of a sheet stack formation control in the sheet processing apparatus of this embodiment; FIG. 27 is a schematic view showing a state of sheet stacking on the process tray; FIG. 28 is a schematic view showing a state of a sheet rear end alignment; FIG. 29 is a schematic view showing a state of a sheet lateral end alignment; FIG. 30 is a schematic view showing a state of returning the offset roller to a home position; and FIG. 31 is a chart showing a setting of an offset travel distance of the offset roller.

In FIGS. 27, 28, 29 and 30, the offset roller arm 1407 is illustrated outside a pair of the offset rollers 1407 for the purpose of easier understanding, but is in fact provided between the pair of the offset rollers 1407 as shown in FIG. 23. Also the lateral end alignment plate 1416 is provided, as shown in FIG. 27, parallel to the sheet transport direction.

In the sheet processing apparatus 1400 of the present embodiment, at the lateral end alignment, the transport distance, including slippage, for impingement on the lateral end alignment plate 1416, namely the offset travel amount of the offset roller 1407, is made larger for a first sheet to be stacked on the process tray 1410 in comparison with that for second and subsequent sheet to be stacked on the process tray 1410.

After the sheet entrained by the offset roller 1407 impinges on the lateral end alignment plate 1416, the offset roller 1407 slips on the sheet to correct the skew of the sheet relative to the lateral end alignment plate 1416, and the lateral end alignment is terminated after a further slippage. As an ordinary sheet shows a friction larger between the sheet and the process tray 1410 than between the sheets, the CPU 1111 increases the offset travel amount of the offset roller 1407 for the first sheet to be stacked on the process tray 1410.

In the sheet processing apparatus 1400, the CPU 1111 executes the lateral end alignment by increasing the offset travel amount for the first sheet to be stacked on the process tray 1410. It is thus rendered possible to alleviate an alignment failure caused by a situation where the sheet does not reach the lateral end alignment plate 1416 by the friction with the process tray 1410, thereby reducing the aberration in the sheet alignment at the lateral end alignment and enabling a highly precise lateral end alignment. Also the CPU 1111 recognizes sheet information such as sheet size on the sheet, transmitted from the main body 1500A, reflects various frictional conditions identified from such sheet information on the rotation amount of the offset motor 432 for moving the offset roller 1407 in the width direction.

The controller 1501 (FIG. 19) of the main body 1500A holds the size of the sheet to be delivered from the sheet delivery portion 1208. Therefore, the CPU 1111 executes a serial communication with the controller 1501. The CPU 1111, thus judging the width size of the sheet stacked on the process tray 1410, calculates the offset travel amount to the lateral end alignment plate 1416 (FIG. 27), then corrects the offset travel amount according to the sheet stack state on the process tray 1410 and the sheet size, and executes the lateral end alignment utilizing thus calculated and corrected offset travel amount.

Referring to FIGS. 26A to 26C, when a copying operation is started in the main body 1500A (FIG. 19), the CPU 1111 awaits a sheet delivery signal from the controller 1501 of the main body 1500A (S1100). Upon receiving the sheet delivery signal from the controller 1501 through the serial interface 1130, the CPU 1111 activates the pickup solenoid 1433 shown in FIG. 23 to rotate the offset roller arm 1406 in a direction U shown in FIG. 22, thereby lifting the offset roller 1407 (S110).

Then, as shown in FIG. 27, the CPU 1111 activates the transport motor 1431, thereby rotating the transport roller 1405 and the offset roller 1407 in a direction E. Thus the transport roller 1405 is rendered capable of transporting the sheet in a direction same as the sheet transport direction of the main body 1500A, while the offset roller 1407 rotates in a lifted state (S1120) thereby awaiting delivery of the sheet to the process tray 1410 by the transport roller 1405.

Then the CPU 1111, upon receiving a sheet entry detection signal, indicating the rear end detection of the first sheet, from the entrance sensor 1403 (FIG. 19) (S1130), deactivates the pickup solenoid 1433 thereby lowering the offset roller 1407 by the weight thereof for contacting the sheet surface as indicated by a solid line in FIG. 27 (S1140). The offset roller 1407 rotating in the direction E continues rotation by the transport motor 1431 and transports the sheet in a direction F.

When the sheet is transported to a predetermined position beyond the clamp claw 1412 shown in FIG. 25 (S1150), the CPU 1111 stops the transport motor 1431 to interrupt the rotation of the offset roller 1407, thereby terminating the sheet transport in the direction F (S1160).

As the sheet is a first sheet, the CPU 1111 activates the clamp solenoid 1434 (FIG. 22) to open the clamp claw 1412 of the clamp mechanism 1413 waiting at the home position 1413*a* (FIG. 25) (S1170).

Then the CPU 1111 reverses the transport motor 1431 to rotate, as shown in FIG. 28, the offset roller 1407 in a direction G opposite to the sheet transport direction (S1180), thereby inversely feeding the sheet toward the upstream side in a direction K and executing the rear end alignment by a rear end impingement on the rear end stopper 1411 (S1190), and then terminates the rotation of the offset roller 1407 (S1200).

Then, based on the sheet information received from the controller 1501, the CPU 1111 discriminates whether the sheet is to be subjected to a stapling process (S1210), and, if not (NO in S1210), lifts the offset roller 1407 without executing a lateral end alignment (S1290) and closes the clamp claw 1412.

In the stapling process is to be executed (YES in S1210), the CPU 1111 recognizes the sheet size based on the data received from the controller 1501 (FIG. 19) and calculates an offset travel amount according to the sheet size.

A distance between the lateral end alignment plate 1416 and the lateral end of the sheet is, as shown in FIG. 31, 10 mm in case of a longitudinally fed A3-sized sheet, and 30, 53 or 67 mm respectively in case of a B4, A4 or B5-sized sheet. The slippage between the offset roller 1407 and the sheet surface at the sheet travel increases for a larger sheet size. For this reason, each sheet travel distance is multiplied by a correction rate of 1.2, 1.1, 1.0 or 1.0, in consideration of the slip amount, respectively for the A3, B4, A4 or B5 sheet size.

The CPU 1111, upon identifying a first sheet on the process tray 1410, corrects and increases the offset travel amount in comparison with that for a second or subsequent sheet. More specifically, the correction value by the sheet size is further multiplied by 1.12 for the first sheet, or by 1.05 for the second or subsequent sheet (S1220).

Also in case a sheet has a friction different from that of other sheets in the sheet stack, as indicated by the sheet friction information attached to the received data, or in case the sheet size is changed, the offset travel amount is corrected anew and set at an optimum level for each sheet.

The CPU 1111 activates the offset motor 1432 to move the offset roller 1407, which is stopped in rotation, toward the lateral end alignment plate 1416 by the offset travel amount set for each sheet. In this operation, the sheet in contact with the offset roller 1407 is frictionally entrained toward the lateral end alignment plate 1416 (S1221). The sheet is skew corrected by impinging on the lateral end alignment plate 1416, and then the offset roller 1407 slips on the sheet for a while to complete the lateral end alignment.

After the lateral end alignment, the CPU 1111, in order to correct a certain alignment error at the sheet rear end generated by the offset travel of the sheet, rotates the offset roller 1407 again in a direction opposite to the sheet transport direction, thereby causing the sheet rear end to impinge on the rear end stopper 1411 (S1230).

After the rear end alignment, the CPU 1111 activates the pickup solenoid 1433 to lift the offset roller 1407 (S1250), and then deactivates the clamp solenoid 1434 to close the clamp claw 1412, thereby pinching and holding the aligned sheet (S1260). Thus, the sheet on the process tray 1410 is not entrained by a next delivered sheet in the sheet transport direction. The offset roller 1407 in the lifted state moves, by the offset motor 1432 and through the rack 1441 and the pinion 1439, to the initial home position (S1270).

Thereafter, the CPU 1111 judges the sheet information from the controller 1501 to discriminate whether the sheet, stacked on the process tray 1410, is a sheet corresponding to a last page of the originals to be copied (S1280). If not (NO in S1280), the CPU 1111 returns to the step S1100 to receive a next sheet delivery signal transmitted from the controller 1501, and thus repeats the flow of S1100 to S1280 until a sheet corresponding to the last page is stacked on the process tray 1410.

In this manner the CPU 1111 of the sheet processing apparatus 1400 recognizes the sheet size for each sheet delivery from the main body 1500A and aligns the sheet in an offset position suitable for the stapling process thereof.

On the other hand, in case a last sheet is identified (YES in S1280), a sheet stack corresponding to the originals to be copied should have been formed on the process tray 1410, and the CPU 1111 discriminates whether a stapling process is selected (S1300), and, if selected (YES in S1300), drives the stapling unit 1420 thereby executing a stapling process (S1310).

If the stapling process is completed or the stapling process is not selected (NO in S13000), the CPU 1111 activates the sheet stack delivery motor 1430 to displace the clamp mechanism 1413 by the rack 1452 and the pinion 1451. The clamp mechanism 1413 advances, in a state of pinching the sheet stack in the clamp claw 1412, from the home position 1413*a* toward the stack tray 1421 to the stack delivery position 1413*b* (S1320). Thereafter, it activates the clamp solenoid 1434 to open the clamp claw 1412, thereby dropping the sheet stack onto the stack tray 1421.

Then the CPU 1111 executes a descending operation of the stack tray 1421 by the thickness of the delivered sheet stack (S1330). In the sheet processing apparatus 1400 of the present embodiment, since the sheet stack on the stack tray 1421 constitutes a part of the process tray 1410, the stack tray 1421 is lowered by the stack tray elevating motor 1135 when the sheet stack is delivered from the process tray 1410, to such a position where the uppermost surface of the sheet stack on the stack tray 1421 substantially matches the process tray 1410.

The CPU 1111 returns the clamp mechanism 1413 to the home position 1413*a* (S1340), then deactivates the transport motor 1431 to terminate rotation of the transport roller 1405 and the offset roller 1407 (S1350), and turns off the pickup solenoid 1433 to lower the offset roller 1407 onto the process tray 1410 (S1360). In this manner the sequential process, for example, of aligning the rear end of the sheet by the rear end stopper 1411, then aligning the lateral end of the sheet by the lateral end alignment plate 1416, then stapling the sheet stack, formed on the process tray 1410, by the stapler unit 1420 and discharging it onto the stack tray 1421, is completed.

In the above-explained procedure, the sheet stack formed by alignments on the rear end and the lateral end may be directly delivered, without the stapling process by the stapler unit 1420.

The sheet or the sheet stack need not necessarily be discharged to the stack tray 1421, but may be directly taken out by the operator from the process tray 1410.

In the sheet processing apparatus 1400 of the present embodiment, a program corresponding to the control sequence of the flow charts shown in FIGS. 26A to 26C are stored in the ROM 1110 shown in FIGS. 21A and 21B, and the CPU 1111 executes the control by reading such program. Instead, similar effects can be obtained by executing the processes on the control program by hardware.

Also in the sheet processing apparatus of the present embodiment, the offset travel amount of the offset roller 1407 is corrected according to the sheet size and the number of stacked sheets, but friction-related data may be separately added to the data received from the controller 1501 (FIG. 19). Also the correction of the offset travel amount by the friction-related data may be further intensified, within relying on the received data, by providing the sheet processing apparatus 1400 with a sensor capable of acquiring friction-related data.

For example it is possible to handle, for example, a coated paper having significantly different friction coefficients on the top and rear surfaces, by employing different coefficients respectively for a case where the top surface of the sheet has a higher friction coefficient than in the rear surface, a case where the rear surface has a higher friction coefficient, and a case where the top and rear surfaces have a substantially same friction coefficient. It is also possible to utilize different coefficients for a two-side printing and a one-side printing, or for a color printing and a monochromatic printing, and also to vary the coefficient for every 10 sheets stacked on the process tray 14101. Also the offset travel amount may be selected smaller for a thin sheet or a sheet of low rigidity for giving priority to the sheet protection, or may be varied according to an ambient temperature, a humidity and a frequency of image formations.

As explained in the foregoing, by optimizing the offset travel amount of the offset roller 1407 at the offset travel of the sheet, it is rendered possible to realize a secure impingement of the sheet lateral end on the lateral end alignment plate 1416 thereby eliminating the skew and improving the quality of lateral end alignment of the sheet without causing a crease or a bend in the sheet, through a mere change in the program of the CPU 1111 without any addition of particular components and without any change in the mechanical structure.

The disclosure of Japanese Patent Application No. 2005-133674 filed Apr. 28, 2005 including specification, drawing and claims is incorporated herein by reference in its entirety.

What is claimed is:

1. A sheet processing apparatus comprising:

a process tray on which a sheet is stacked;

a delivery member configured to deliver a sheet to the process tray, a stopper positioned adjacent to the process tray and configured to be in contact with the sheet delivered to the process tray;

a transport member configured to at least one of rotate and move in a state of pressing the sheet toward the process tray, and to transport the sheet on the process tray thereby contacting the sheet with the stopper; and a controller configured to change at least one of an amount of rotation and an amount of movement of the transport member in case the process tray has a single sheet stacked thereon and in case the process tray has a plurality of sheets stacked thereon, wherein the stopper is positioned at an upstream side of a delivery direction by the delivery member and is adapted to be in contact with a rear end of the sheet on the process tray, and the transport member transports the sheet to the upstream side in a state of contacting a surface of the sheet thereby pressing the sheet toward the process tray.

2. A sheet processing apparatus according to claim 1, further comprising:

a lateral end stopper positioned at an end side in a direction which crosses the delivery direction by the delivery member and is adapted to be in contact with a lateral end of the sheet on the process tray, and wherein the transport member transports the sheet to the end side in a direction which crosses the delivery direction by the delivery member in a state of contacting the surface of the sheet thereby pressing the sheet toward the process tray.

3. A sheet processing apparatus according to claim 1, wherein the controller increases at least one of the amount of rotation and the amount of movement in case the process tray has a single sheet stacked thereon.

4. A sheet processing apparatus according to claim 1, wherein the controller determines at least one of the amount of rotation and the amount of movement based on a size of the sheet.

5. A sheet processing apparatus comprising:

a process tray on which a sheet is stacked;

a delivery member configured to deliver the sheet onto the process tray;

a rear end stopper positioned at an upstream side of a delivery direction by the delivery member and configured to be in contact with a rear end of the sheet on the process tray;

a lateral end stopper positioned at an end side in a direction which crosses the delivery direction by the delivery member and configured to be in contact with a lateral end of the sheet on the process tray;

a transport member positioned vertically movably above the process tray and configured to rotate for transporting the sheet delivered on the process tray and contacting with the rear end stopper, and also to move the sheet for contacting with the lateral end stopper; and a controller configured to change at least one of an amount of rotation and an amount of movement of the transport member in case the process tray has a single sheet stacked thereon and in case the process tray has a plurality of sheets stacked thereon.

6. A sheet processing apparatus according to claim 5, wherein the controller increases at least one of the amount of rotation and the amount of movement in case the process tray has a single sheet stacked thereon.

7. An image forming apparatus comprising a sheet processing apparatus according to claim 1.

* * * * *